US008017534B2

(12) United States Patent
Harvey et al.

(10) Patent No.: US 8,017,534 B2
(45) Date of Patent: Sep. 13, 2011

(54) FIBROUS NONWOVEN STRUCTURE HAVING IMPROVED PHYSICAL CHARACTERISTICS AND METHOD OF PREPARING

(75) Inventors: James Benjamin Harvey, Spring City, TN (US); Anthony Mark Gambaro, Appleton, WI (US); Paul Alan Giles, Marietta, GA (US); David Jon Baer, Oshkosh, WI (US); Allen Frederic Vater, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 29 days.

(21) Appl. No.: 12/402,131

(22) Filed: Mar. 11, 2009

(65) Prior Publication Data

US 2009/0233072 A1 Sep. 17, 2009

Related U.S. Application Data

(60) Provisional application No. 61/069,939, filed on Mar. 17, 2008.

(51) Int. Cl.

| | |
|---|---|
| ***D04H 1/00*** | (2006.01) |
| ***D04H 13/00*** | (2006.01) |
| ***D04H 3/00*** | (2006.01) |
| ***D04H 5/00*** | (2006.01) |
| ***D04H 3/16*** | (2006.01) |

(52) U.S. Cl. ..... 442/344; 442/340; 442/345; 442/351; 442/381; 442/400; 428/219; 264/115

(58) Field of Classification Search ..... 442/381, 442/400, 340, 344, 345, 351; 428/219; 264/115
See application file for complete search history.

(56) References Cited

U.S. PATENT DOCUMENTS

| | | | | |
|---|---|---|---|---|
| 3,338,992 | A | 8/1967 | Kinney | |
| 3,341,394 | A | 9/1967 | Kinney | |
| 3,502,763 | A | 3/1970 | Hartmann | |
| 3,542,615 | A | 11/1970 | Dobo et al. | |
| 3,692,618 | A | 9/1972 | Dorschner | |
| 3,802,817 | A | 4/1974 | Matsuki et al. | |
| 3,849,241 | A | 11/1974 | Butin et al. | |
| 4,100,324 | A * | 7/1978 | Anderson et al. | 442/344 |
| 4,340,563 | A | 7/1982 | Appel et al. | |

(Continued)

FOREIGN PATENT DOCUMENTS

KR 10-2004-0009721 A 1/2004

(Continued)

OTHER PUBLICATIONS

American Society for Testing Materials (ASTM) Designation: E 11-87, "Standard Specification for Wire-Cloth Sieves," pp. 13-16, published Jul. 1987.

*Primary Examiner* — Norca L Torres-Velazquez
(74) *Attorney, Agent, or Firm* — R. Joseph Foster, III

(57) ABSTRACT

Disclosed is a fibrous nonwoven structure comprising melt-blown fibrous materials and at least one secondary fibrous material and method of preparing. In one aspect, the fibrous nonwoven structure has a formation index of between 70 and 135. In another aspect, the fibrous nonwoven structure has an opacity that is greater than 72 percent at a basis weight of between about 35 and 55 grams per square meter. The fibrous nonwoven substrate may be utilized as a moist wipe.

28 Claims, 8 Drawing Sheets

U.S. PATENT DOCUMENTS 4,426,417 A * 1/1984 Meitner et al. ..... 428/195.1
4,528,239 A 7/1985 Trokhan
4,741,941 A 5/1988 Englebert et al.
4,789,592 A 12/1988 Taniguchi et al.
4,795,668 A 1/1989 Krueger et al.
5,057,368 A 10/1991 Largman et al.
5,069,970 A 12/1991 Largman et al.
5,108,820 A 4/1992 Kaneko et al.
5,162,074 A 11/1992 Hills
5,277,976 A 1/1994 Hogle et al.
5,336,552 A 8/1994 Strack et al.
5,350,624 A 9/1994 Georger et al.
5,382,400 A 1/1995 Pike et al.
5,466,410 A 11/1995 Hills
5,508,102 A * 4/1996 Georger et al. ..... 442/400
5,539,056 A 7/1996 Yang et al.
5,540,332 A 7/1996 Kopacz et al.
5,596,052 A 1/1997 Resconi et al.
5,628,876 A 5/1997 Ayers et al.
5,667,635 A 9/1997 Win et al.
5,744,007 A 4/1998 Trokhan et al.
5,888,524 A 3/1999 Cole
5,964,351 A 10/1999 Zander
6,018,018 A 1/2000 Samuelson et al.
6,030,331 A 2/2000 Zander
6,158,614 A 12/2000 Haines et al.
6,200,669 B1 3/2001 Marmon et al.
6,269,969 B1 8/2001 Huang et al.
6,269,970 B1 8/2001 Huang et al.
6,273,359 B1 8/2001 Newman et al.
6,440,437 B1 8/2002 Krzysik et al.
6,500,563 B1 12/2002 Datta et al.
6,660,129 B1 12/2003 Cabell et al.
6,972,104 B2 12/2005 Haynes et al.
6,992,159 B2 1/2006 Datta et al.
7,081,299 B2 7/2006 Richeson
7,105,609 B2 9/2006 Datta et al.
7,320,821 B2 1/2008 Prodoehl
2003/0200991 A1 * 10/2003 Keck et al. ..... 134/6
2003/0211802 A1 * 11/2003 Keck et al. ..... 442/400
2005/0043489 A1 2/2005 Datta et al.
2005/0136781 A1 6/2005 Lassig et al.
2006/0172647 A1 8/2006 Mehta et al.
2007/0049153 A1 3/2007 Dunbar et al.
2007/0065643 A1 3/2007 Kopacz et al.
2007/0098768 A1 5/2007 Close et al.
2007/0148447 A1 6/2007 Amundson et al.
2007/0197117 A1 8/2007 Austin et al.
2008/0076315 A1 3/2008 McCormack et al.
2008/0095970 A1 4/2008 Takashima et al.
2008/0132866 A1 6/2008 Siqueira et al.

FOREIGN PATENT DOCUMENTS

WO WO 02/38846 5/2002
WO WO 2004/061181 7/2004

* cited by examiner

FIBROUS NONWOVEN STRUCTURE HAVING IMPROVED PHYSICAL CHARACTERISTICS AND METHOD OF PREPARING

RELATED APPLICATION DATA

This application claims priority to U.S. Provisional Application Ser. No. 61/069,939, filed Mar. 17, 2008, which is fully incorporated by reference herein.

BACKGROUND

The present disclosure relates to a fibrous nonwoven structure comprising at least one meltblown fibrous material and at least one secondary fibrous material and a method for making a fibrous nonwoven structure, wherein the nonwoven structure has improved physical characteristics.

Fibrous nonwoven structures are widely used as products or as components of products because they can be manufactured inexpensively and can be made to have specific characteristics.

Fibrous nonwoven structures can be used in a wide variety of applications including absorbent media for aqueous and organic fluids, filtration media for wet and dry applications, insulating materials, protective cushioning materials, containment and delivery systems and wiping media for both wet and dry applications, and particularly for baby wipes. Many of the foregoing applications can be met, to varying degrees, through the use of more simplified structures such as absorbent structures wherein only wood pulp fibers are used. This has commonly been the case with, for example, the absorbent cores of personal care absorbent products such as diapers. Wood pulp fibers when formed by themselves tend to yield nonwoven web structures which have very little mechanical integrity and a high degree of collapse when wetted. The advent of fibrous nonwoven structures which incorporated thermoplastic meltblown fibrous materials, even in small quantities, greatly enhanced the properties of such structures including both wet and dry tensile strength. The same enhancements were also seen with the use of fibrous nonwoven structures for wiping sheets.

However, the current nonwoven fibrous structures can be improved. Physical characteristics such as formation, size of fibers, anisotropy, tensile strength and the amount of lint can be improved by enhancing the manufacturing process. In particular, these characteristics are useful for nonwoven fibrous structures for use as a wet wipe. Additionally there is a need for a fibrous nonwoven structure produced at lower basis weights with improved physical characteristics. Such a manufacturing process will be much more efficient and less expensive.

SUMMARY

Generally, a fibrous nonwoven structure comprising meltblown fibrous materials, the meltblown fibrous materials having an average diameter of about 2 to 40 μm and at least one secondary fibrous material, is disclosed. In an exemplary aspect, the formation index of the nonwoven structure is greater than 70 and desirably between about 70 to 135. In a further aspect, the formation index of the nonwoven structure is between about 75 to 115.

In a further aspect, a fibrous nonwoven structure comprising meltblown fibrous materials and at least one fibrous material wherein the opacity value of the nonwoven structure is greater than 72% and a basis weight of between about 35 gsm (grams per square meter) and 55 gsm is disclosed.

In another aspect, the fibrous nonwoven structure is stronger in the machine direction at higher throughputs. The machine direction tensile strength of the nonwoven structure is between about 650 grams-force and 1500 grams-force at a polymer throughput of between about 0.88 ghm (grams per hole per minute) and 1.76 ghm, or a polymer throughput of between about 3.5 pih (pounds of polymer melt per inch of die) and 7.0 pih. In another aspect, the fibrous nonwoven structure has an anisotropy ratio between about 0.4 and about 0.65 indicating better sheet squareness.

In another aspect, the fibrous nonwoven structure is softer. For example, a surface roughness of the fibrous nonwoven structure is in a range of about 0.03 to about 0.06 mm. Additionally, an average meltblown fiber diameter of the fibrous nonwoven structure is less than 3.5 μm at a polymer throughput of between about 0.88 ghm and 1.76 ghm or a polymer throughput of between about 3.5 pih and 7.0 pih. A volume weighted mean diameter of the meltblown fibrous materials is between about 4.0 and about 8.0 μm at a polymer throughput of between about 0.88 ghm and 1.76 ghm or a polymer throughput of between about 3.5 pih and 7.0 pih. Smaller fiber diameters correspond to a softer feel to a consumer.

In another aspect, the fibrous nonwoven structure provides less residue behind on the surface on which it is used. For example, the fibrous nonwoven structure has a lint count between about 200 to about 950. Less lint provides for less residue or particles left behind after use by a consumer.

In exemplary applications, the fibrous nonwoven structure may be used as a wet wipe, wherein the wet wipe has from about 150 to 600 weight percent of a liquid based on a dry weight of the fibrous nonwoven structure.

In another aspect, the present disclosure is directed to a method of making a fibrous nonwoven structure providing a first stream and a second stream of meltblown fibrous materials, the meltblown fibrous materials having an average diameter of about 2 to 40 μm, the first stream and second stream meeting at a formation zone and providing a stream of secondary fibrous materials meeting the first stream and the second stream at the formation zone and forming into a product stream. The product stream is collected on a forming wire as a mixture of meltblown fibrous materials and at least one secondary fibrous material.

BRIEF DESCRIPTION

DETAILED DESCRIPTION

Definitions

Figure 1:
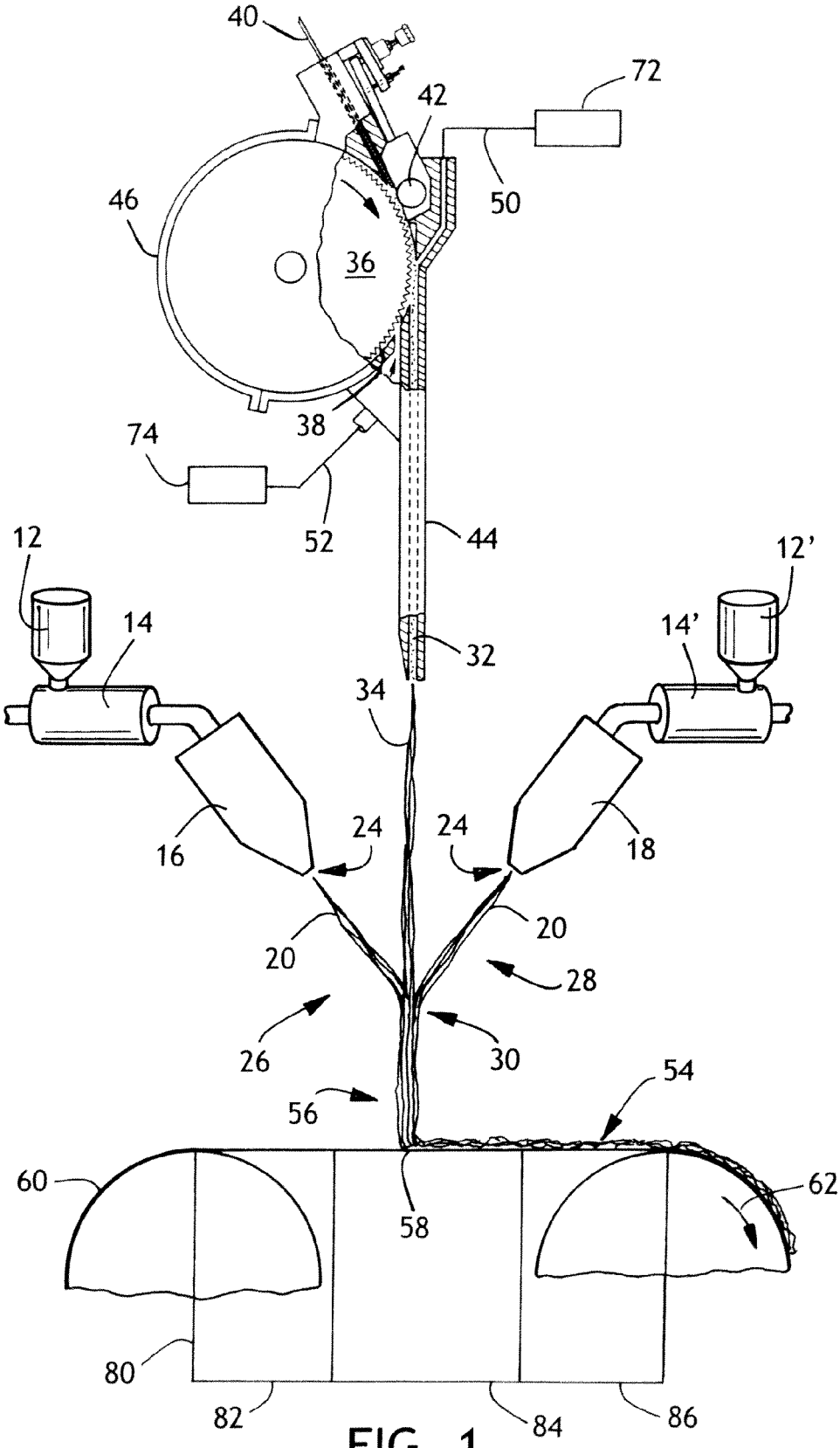
FIG. 1 illustrates an exemplary apparatus which may be utilized to produce a fibrous nonwoven structure.

As used herein, the term "nonwoven fabric or web" means a web having a structure of individual fibers or threads which are interlaid, but not in a regular or identifiable manner, as in a knitted fabric. It also includes foams and films that have been fibrillated, apertured or otherwise treated to impart fabric-like properties. Nonwoven fabrics or webs have been formed from many processes such as, for example, meltblowing processes, spunbonding processes, hydroentangled processes, and bonded carded web processes. The basis weight of nonwoven fabrics is usually expressed in ounces of material per square yard (osy) or grams per square meter (gsm), and the fiber diameters are usually expressed in μm. (Note that to convert from osy to gsm, multiply osy by 33.91.)

As used herein, the term "microfibers" means small diameter fibers having an average diameter of not greater than about 75 μm, for example, having an average diameter of from about 0.5 μm to about 50 μm, or more particularly, having an average diameter of from about 2 μm to about 40 μm. Another frequently used expression of fiber diameter is denier, which is defined as grams per 9,000 meters of a fiber, and may be calculated as fiber diameter in μm squared, multiplied by the density in grams/cc, multiplied by 0.00707. A lower denier indicates a finer fiber and a higher denier indicates a thicker or heavier fiber. For example, a diameter of a polypropylene fiber given as 15 μm may be converted to denier by squaring, multiplying the result by 0.89 g/cc and multiplying by 0.00707. Thus, a 15 μm polypropylene fiber has a denier of about 1.42 ($15^2 \times 0.89 \times 0.00707 = 1.415$). Outside the United States, the unit of measurement is more commonly the "tex", which is defined as the grams per kilometer of fiber. Tex may be calculated as denier/9.

As used herein, the term "meltblown fibrous materials" means fibers formed by extruding a molten thermoplastic material through a plurality of fine, usually circular, die capillaries as molten threads or filaments into converging high velocity gas (for example, airstreams) which attenuate the filaments of molten thermoplastic material to reduce their diameter, which may be to microfiber diameter. Thereafter, the meltblown fibrous materials are carried by the high velocity gas stream and are deposited on a collecting surface to form a web of randomly dispersed meltblown fibrous materials. Meltblown fibrous materials are microfibers which may be continuous or discontinuous, and are generally smaller than 10 μm in average diameter.

As used herein, the term "polymer throughput" means the throughput of the polymer through the die and is specified in pounds of polymer melt per inch of die width per hour (pih) or grams of polymer melt per hole per minute (ghm). To calculate throughput in pih from units of ghm, multiply ghm by the number of fiber emitting holes per inch of fiber-forming die (holes/inch), then divide by 7.56. The dies used to produce the fibrous nonwoven structure have 30 holes per inch.

Generally, a fibrous nonwoven structure comprising at least one meltblown fibrous material, the meltblown fibrous materials having an average diameter of about 0.5 to 40 μm and at least one secondary fibrous material is disclosed. In an exemplary aspect, the basesheet can be made from a variety of materials including meltblown materials, coform materials, air-laid materials, bonded-carded web materials, hydroentangled materials, spunbond materials and the like, and can comprise synthetic or natural fibers.

The fibrous nonwoven structure may be used as a wet wipe, and in particular for baby wipes. Different physical characteristics of the fibrous nonwoven structure may be varied to provide the best quality wet wipe. For example, formation, diameter of meltblown fibers, the amount of lint, opacity and other physical characteristics of the fibrous nonwoven structure may be altered to provide a useful wet wipe for consumers.

Typically, the fibrous nonwoven structure is a combination of meltblown fibrous materials and secondary fibrous materials, the relative percentages of the meltblown fibrous materials and secondary fibrous materials in the layer can vary over a wide range depending on the desired characteristics of the fibrous nonwoven structure. For example, fibrous nonwoven structures can have from about 20 to 60 weight percent of meltblown fibrous materials and from about 40 to 80 weight percent of secondary fibers. Desirably, the weight ratio of meltblown fibrous materials to secondary fibers can be from about 20/80 to about 60/40. More desirably, the weight ratio of meltblown fibrous materials fibers to secondary fibers can be from 25/75 to about 40/60.

The fibrous nonwoven structure may have a total basis weight of from about 20 to about 120 gsm and desirably from about 40 to about 90 gsm. Such basis weight of the fibrous nonwoven structure may also vary depending upon the desired end use of the fibrous nonwoven structure. For example, a suitable fibrous nonwoven structure for wiping the skin may define a basis weight of from about 30 to about 80 gsm and desirably about 45 to 60 gsm. The basis weight (in grams per square meter, g/m2 or gsm) is calculated by dividing the dry weight (in grams) by the area (in square meters).

In an exemplary aspect, one approach is to mix meltblown fibrous materials with one or more types of secondary fibrous materials and/or particulates. The mixtures are collected in the form of fibrous nonwoven webs which may be bonded or treated to provide coherent nonwoven materials that take advantage of at least some of the properties of each component. These mixtures are referred to as "coform" materials because they are formed by combining two or more materials in the forming step into a single structure.

A nonwoven fabric-like material having a unique combination of strength and absorbency comprising an air-formed mixture of thermoplastic polymer microfibers and a multiplicity of individualized secondary fibrous materials disposed throughout the mixture of microfibers and engaging at least some of the microfibers to space the microfibers apart from each other is desirable.

Meltblown fibrous materials suitable for use in the fibrous nonwoven structure include polyolefins, for example, polyethylene, polypropylene, polybutylene and the like, polyamides, olefin copolymers and polyesters. In accordance with a particularly desirable aspect, the meltblown fibrous materials used in the formation of the fibrous nonwoven structure are polypropylene.

The fibrous nonwoven structure also includes one or more types of secondary fibrous materials to form a nonwoven web. Wood pulp fibers are particularly preferred as a secondary fibrous material because of low cost, high absorbency and retention of satisfactory tactile properties.

The secondary fibrous materials are interconnected by and held captive within the microfibers by mechanical entanglement of the microfibers with the secondary fibrous materials, the mechanical entanglement and interconnection of the microfibers and secondary fibrous materials alone forming a coherent integrated fiber structure. The coherent integrated fiber structure may be formed by the microfibers and secondary fibrous materials without any adhesive, molecular or hydrogen bonds between the two different types of fibers. The material is formed by initially forming a primary air stream containing the meltblown microfibers, forming a secondary air stream containing the secondary fibrous materials, merging the primary and secondary streams under turbulent conditions to form an integrated air stream containing a thorough mixture of the microfibers and secondary fibrous materials, and then directing the integrated air stream onto a forming surface to air form the fabric-like material. The microfibers are in a soft nascent condition at an elevated temperature when they are turbulently mixed with the pulp fibers in air.

The fibrous nonwoven structure disclosed herein typically has a high formation index. In exemplary aspects, the fibrous nonwoven structure has a formation index of greater than 70, and desirably between about 70 to about 135. In other aspects, the fibrous nonwoven structure has a formation index of between about 75 to 115. Improvements in formation (or sheet uniformity), as measured by formation index values, have been known to improve fabric strength and thus the performance of the fabric in its conversion or use by consumers in wiping applications. Formation also provides a softer feel to the fibrous nonwoven structure for a consumer.

In a further aspect, a fibrous nonwoven structure comprising meltblown fibrous materials and at least one fibrous material wherein the opacity of the fibrous nonwoven structure is greater than 72% and a basis weight of between about 35 to 55 gsm is disclosed. High opacity values are an indicator of improved fabric strength to a consumer. If the consumer can see through the fibrous nonwoven structure, he or she will feel as if the product is not strong enough for all its uses. Keeping opacity levels high will indicate to the consumer that the fibrous nonwoven structure is strong and may be used for more versatile wiping applications. The fibrous nonwoven structure described herein allows the opacity to remain high at lower basis weights, providing a significant manufacturing advantage.

In another aspect, the fibrous nonwoven structure is stronger in the machine direction at higher throughputs. The machine direction tensile strength of the nonwoven structure is between about 650 grams-force and 1500 grams-force at a polymer throughput of between about 0.88 ghm (grams per hole per minute) and 1.76 ghm. A higher machine direction tensile strength illustrates a more durable sheet with improved dispensing characteristics in wiping applications. In another aspect, the fibrous nonwoven structure has an anisotropy ratio between about 0.4 and about 0.65 indicating better sheet squareness.

In another aspect, the fibrous nonwoven structure is softer. For example, a surface roughness of the fibrous nonwoven structure is in a range of about 0.03 to about 0.06 μm.

Smaller fiber diameter material provides a finer and softer texture and corresponds to a softer feel for a consumer of the fibrous nonwoven structure. An average meltblown fiber diameter of the fibrous nonwoven structure is less than 3.5 μm at a polymer throughput of between about 0.88 ghm and 1.76 ghm. A volume weighted mean diameter of the meltblown fibrous materials is between about 4.0 and about 8.0 mm at a polymer throughput of between about 0.88 ghm and 1.76 ghm.

In another aspect, the fibrous nonwoven structure leaves less residue behind on the surface on which it is used. For example, the fibrous nonwoven structure has a lint count between about 200 to about 950. Less lint provides for less residue or particles left behind after use by a consumer.

Turning now to the figures wherein like reference numerals represent the same or equivalent structure and, in particular, to FIG. 1, wherein an exemplary apparatus 10 for forming a fibrous nonwoven structure is illustrated. In forming an exemplary fibrous nonwoven structure, pellets or chips, etc. (not shown) of a thermoplastic polymer are introduced into a pellet hopper 12, 12' of an extruder 14, 14'.

The extruder 14 has an extrusion screw (not shown) which is driven by a conventional drive motor (not shown). As the polymer advances through the extruder 14, due to rotation of the extrusion screw by the drive motor, it is progressively heated to a molten state. Heating the thermoplastic polymer to the molten state may be accomplished in a plurality of discrete steps with its temperature being gradually elevated as it advances through discrete heating zones of the extruder 14 toward two meltblowing dies 16 and 18, respectively. The meltblowing dies 16 and 18 may be yet another heating zone where the temperature of the thermoplastic resin is maintained at an elevated level for extrusion.

Each meltblowing die is configured so that two streams of attenuating gas per die converge to form a single stream of gas which entrains and attenuates molten threads 20, as the threads 20 exit small holes or orifices 24 in the meltblowing die. The molten threads 20 are attenuated into fibers or, depending upon the degree of attenuation, microfibers, of a small diameter which is usually less than the diameter of the orifices 24. Thus, each meltblowing die 16 and 18 has a corresponding single primary air stream 26 and 28 of gas containing entrained and attenuated polymer fibers. The primary air streams 26 and 28 containing polymer fibers are aligned to converge at a formation zone 30.

One or more types of secondary fibrous materials 32 (and/or particulates) are added to the two primary air streams 26 and 28 of thermoplastic polymer fibers or microfibers 24 at the formation zone 30. Introduction of the secondary fibrous materials 32 into the two primary air streams 26 and 28 of thermoplastic polymer fibers 24 is designed to produce a distribution of secondary fibrous materials 32 within the combined primary air streams 26 and 28 of thermoplastic polymer fibers. This may be accomplished by merging a secondary gas stream 34 containing the secondary fibrous materials 32 between the two primary air streams 26 and 28 of thermoplastic polymer fibers 24 so that all three gas streams converge in a controlled manner.

Figure 3:
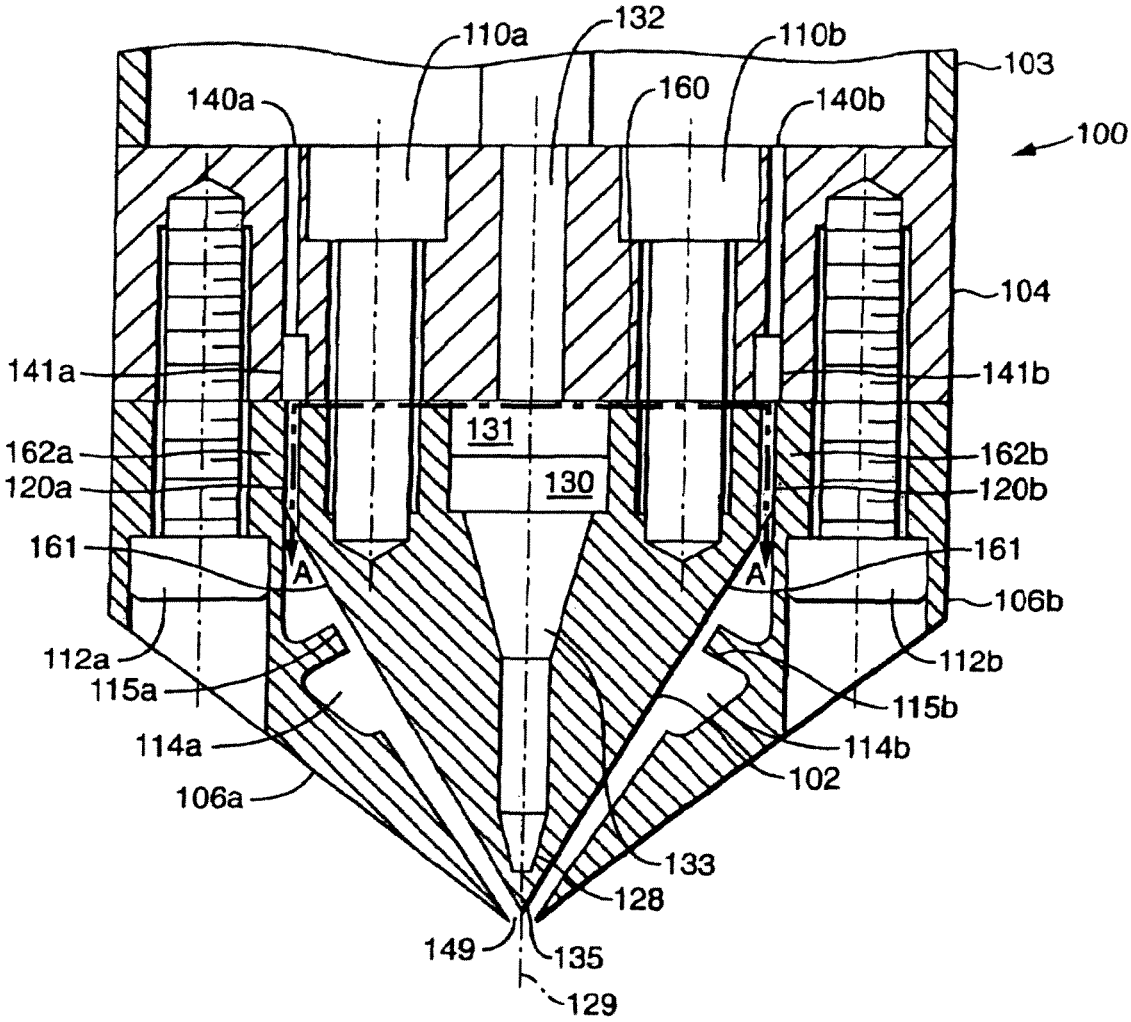
FIG. 3 illustrates an exemplary meltblowing die to be utilized with the disclosed apparatus.

FIG. 3 illustrates a partial cross-sectional view of one aspect of a meltblowing die 100 that may be utilized. Examples of meltblowing dies that may be utilized with the present disclosure are discussed in more detail in U.S. Pat. No. 6,972,104 issued to Haynes et al. on Dec. 6, 2005 entitled Meltblown Die Having a Reduced Size, hereby incorporated by reference in its entirety. In FIG. 3 a die tip 102 is mounted indirectly to a die body 103 (partially shown) through a mounting plate 104. Also mounted indirectly to a die body mounting plate 104 are a first air plate **106*a* and a second air plate 106*b*. The die tip 102 is mounted to the mounting plate 104 using any suitable means, such as bolts. Bolts 110*a* and 110*b* are shown as the mounting means in FIG. 3. In a similar manner, the air plates 106*a* and 106*b* are also mounted to the mounting plate 104 using a suitable mounting means, such as bolts. Bolts 112*a* and 112*b* are shown as the mounting means for the air plates in FIG. 3. It is noted that a mounting plate 104 is not necessary and the die tip 102 and air plates 106*a* and 106*b* may be mounted directly to the die 103. It is desirable to mount the die tip 102 and air plates 106*a* and 106*b* to the mounting plate 104, since it is easier to attach the die tip to the mounting plate 104 than the die body 103** using a mounting means (not shown).

The die tip 102 has a top side 160, and two sides 162*a* and 162*b*, which extend from the top side towards the bottom side 161 of the die tip. In addition, the die tip may have a die tip apex 128 and a breaker plate/screen assembly 130. The material which will be formed into fibers is provided from the die body 103 to the die tip 102 via a passageway 132. The material passes through distribution plate 131 from the passageway 132 to the breaker plate/screen assembly 130. Once through the breaker plate/filter assembly 130, which serves to filter the material to prevent any impurities which may clog the die tip from passing any further through the die tip 102, the material passes through a narrowing passage 133 to narrow cylindrical or otherwise shaped outlet 129, which ejects the material, thereby forming fibers. Typically, the outlet 129 will generally have a diameter in the range of about 0.1 to about 0.6 mm. The outlet 129 is connected to the narrowing passage 133 via capillaries 135, which have the diameter of about the same as the outlet and the capillaries will have a length which is generally about 3 to 15 times the diameter of the die tip capillaries. The actual diameter and length of the outlet and capillaries may vary without departing from the scope of the present disclosure.

A high velocity fluid, generally air, must be provided to the die tip outlet 129 in order to attenuate the fibers. In the illustrated meltblown die, the attenuating fluid is supplied through an inlet in the die body 103, thereby saving space in the width of the die tip. In many conventional and commercially used meltblowing dies, the attenuating fluid is supplied external to the die body, thereby requiring large amounts of space in the machine direction. The attenuating fluid passes through from the die body 103 through passages 140*a* and 140*b* in the mounting plate 104 into distribution chambers 141*a* and 141*b*, respectively. The distribution chambers allow mixing of the attenuating fluid. From the distribution chambers 141*a* and 141*b*, the attenuating fluid is then passed between the air plates 106*a* and 106*b* and die tip 102 via passages 120*a* and 120*b*. The air plates 106*a* and 106*b* are secured to the mounting plate 104 (alternately the die body 103) in such a way that the air plates 106*a* and 106*b* and the die tip 102 form passages 120*a* and 120*b*, which allow the attenuating fluid to pass from the distribution chambers 141*a* and 141*b* in mounting plate 104 towards the outlet opening 129 in the die tip. In addition, air plates 106*a* and 106*b* are proximate to the bottom of the die tip 161 such that channels 114*a* and 114*b* which allow the attenuating fluid to pass from the passages 120*a* and 120*b* to the outlet opening 149 of the meltblowing die 100. Baffles 115*a* and 115*b* aid in the mixing of the attenuating fluid in the channels 114*a* and 114*b* so that streaking of the attenuating fluid does not occur. The attenuating fluid forms the primary air stream holding the meltblown microfibers.

The meltblown dies utilized in the present disclosure provide a reduced machine direction width. Typically, the meltblown dies of the present disclosure have a width of less than about 16 cm (6.25 in). In other aspects, the meltblown dies of the present disclosure have a machine direction width in the range of about 2.5 cm (1 inch) to about 15 cm (5.9 inches) and desirably about 5 cm (2 inches) to about 12 cm (4.7 inches).

A first feature of the meltblown dies is that the attenuating fluid is introduced to the meltblown die assembly in the die body 103. In order to get the attenuating air from the die body 103 to the outlet 149 of the meltblowing die 100, the die provides passages or channels 120*a* and 120*b* created by the die tip 102 and the air plates 106*a* and 106*b*, respectively. Any means can be used to form the passageways 120*a* and 120*b*. One method of providing these channels is to form the die tip such that the sides of the die tip 162*a* and 162*b* have grooves or channels extending from the top side 160 to the bottom side 161 of the die tip. The grooves are formed by forming a series of raised portions on the sides 162*a* and 162*b* which are separated by a series of depressed areas or channels. Stated another way, the raised portions on the sides 162*a* and 162*b* of the die tip define the channels and these channels extend from the top side 161 of the die tip to the bottom side 161 of the die tip.

The apparatus may further comprise a conventional picker roll 36 arrangement which has a plurality of teeth 38 that are adapted to separate a mat or batt 40 of secondary fibrous materials into the individual secondary fibrous materials 32. The mat or batt of secondary fibrous materials 40 which is fed to the picker roll 36 may be a sheet of pulp fibers (if a two-component mixture of thermoplastic polymer fibers and secondary pulp fibers is desired), a mat of staple fibers (if a two-component mixture of thermoplastic polymer fibers and secondary staple fibers is desired) or both a sheet of pulp fibers and a mat of staple fibers (if a three-component mixture of thermoplastic polymer fibers, secondary staple fibers and secondary pulp fibers is desired). In aspects where, for example, an absorbent material is desired, the secondary fibrous materials 32 are absorbent fibers. The secondary fibrous materials 32 may generally be selected from the group including one or more polyester fibers, polyamide fibers, cellulosic derived fibers such as, for example, rayon fibers and wood pulp fibers, multi-component fibers such as, for example, sheath-core multi-component fibers, natural fibers such as silk fibers, wool fibers or cotton fibers or electrically conductive fibers or blends of two or more of such secondary fibrous materials. Other types of secondary fibrous materials 32 such as, for example, polyethylene fibers and polypropylene fibers, as well as blends of two or more of other types of secondary fibrous materials 32 may be utilized. The secondary fibrous materials 32 may be microfibers or the secondary fibrous materials 32 may be macrofibers having an average diameter of from about 300 μm to about 1,000 μm.

The sheets or mats 40 of secondary fibrous materials 32 are fed to the picker roll 36 by a roller arrangement 42. After the teeth 38 of the picker roll 36 have separated the mat of secondary fibrous materials 32 into separate secondary fibrous materials 32 the individual secondary fibrous materials 32 are conveyed toward the stream of thermoplastic polymer fibers or microfibers 24 through a nozzle 44. A housing 46 encloses the picker roll 36 and provides a passageway or gap between the housing 46 and the surface of the teeth 38 of the picker roll 36.

A dilution gas, for example, air, is supplied by a dilution air fan 72 to the passageway or gap between the surface of the picker roll 36 and the housing 46 by way of a gas duct 50. The gas is supplied in sufficient quantity to serve as a medium for conveying the secondary fibrous materials 32 through the nozzle 44.

In exemplary aspects, dual circular manifolds are used as a dilution air fan 72 providing uniform air distribution that delivers air into the gas duct 50. The dilution air provided by the dual circular manifolds delivers pulp fibers uniformly to the formation zone above the wire, or belt 58.

A separate stripper air fan 74 is utilized to provide a secondary stripper air flow entering the system at the junction 52 to help remove the secondary fibrous materials 32 from the teeth 38 of the picker roll 36. Separate dilution air fans 72 and stripper air fans 74 are utilized to allow for operators to balance the stripper air flow allowing for optimum fiber release off of the teeth 38 and an increase in the flowrate of the secondary air stream 34.

Generally speaking, the individual secondary fibrous materials 32 are conveyed through the nozzle 44 at about the velocity at which the secondary fibrous materials 32 leave the teeth 38 of the picker roll 36. In other words, the secondary fibrous materials 32, upon leaving the teeth 38 of the picker roll 36 and entering the nozzle 44 generally maintain their velocity in both magnitude and direction from the point where they left the teeth 38 of the picker roll 36.

Pulp fiberization is achieved through the use of the picker rolls. As rolled pulp is fed into the picker housing, the picker roll teeth 38 individualize fibers and deliver them through a nozzle 44. If pulp feed rates are too high, or tooth/fiber interaction is low, poor fiberization occurs and pulp fiber distribution within the basesheet results in a poorly formed sheet. Applicants have discovered that utilization of higher levels of secondary air stream 34 through the system described above provides for improved sheet formation, especially at higher pulp feed rates.

Typically, the width of the nozzle 44 should be aligned in a direction generally parallel to the width of the meltblowing dies 16 and 18. Desirably, the width of the nozzle 44 should be about the same as the width of the meltblowing dies 16 and 18. Generally speaking, it is desirable for the length of the nozzle 44 to be as short as equipment design will allow.

In order to convert the stream 56 of thermoplastic polymer fibers 24 and secondary fibrous materials 32 into a nonwoven structure 54 composed of a coherent mixture of the thermoplastic polymer fibers 24 having the secondary fibrous materials 32 distributed therein, a collecting device is located in the path of the stream 56. The collecting device may be an endless belt 58 conventionally driven by rollers 60 and which is rotating as indicated by the arrow 62 in FIG. 1. Other collecting devices are well known to those of skill in the art and may be utilized in place of the endless belt 58. For example, a porous rotating drum arrangement could be utilized. The merged streams of thermoplastic polymer fibers and secondary fibrous materials are collected as a coherent mixture of fibers on the surface of the endless belt, or wire 58 to form the nonwoven web 54.

Deposition of the fibers is aided by an under-wire vacuum supplied by a negative air pressure unit, or below wire exhaust system, 80. The illustrated below-wire-exhaust system has an increased number of zones, providing three zones in the machine direction unlike conventional machines. For example, the first zone 82 sits upstream in the machine direction of the formation point, the second zone 84 is directly below the pump nozzle and formation zone, and the third zone 86 is downstream in the machine direction of the formation zone. In exemplary aspects, the second zone 84 has the highest airflow, the first zone 82 has the smallest amount of airflow, and the third zone 86 has higher airflow than the first zone 82, but less than the second zone 84. The zones may also supply the same amount of airflow if found to be optimal. Applicants have discovered that the zoned below-wire-exhaust system 80 provides increased air flow where needed and better control of forming zone air management, resulting in improved formation and uniformity.

The fibrous nonwoven structure 54 is coherent and may be removed from the belt 58 as a self-supporting nonwoven material. Generally speaking, the structure has adequate strength and integrity to be used without any post-treatments such as pattern bonding and the like. If desired, a pair of pinch rollers or pattern bonding rollers may be used to bond portions of the material.

The fibrous nonwoven structure may be adapted for use as a moist wipe which contains from about 100 to about 700 dry weight percent liquid. Desirably, the moist wipe may contain from about 200 to about 450 dry weight percent liquid.

Figure 2:
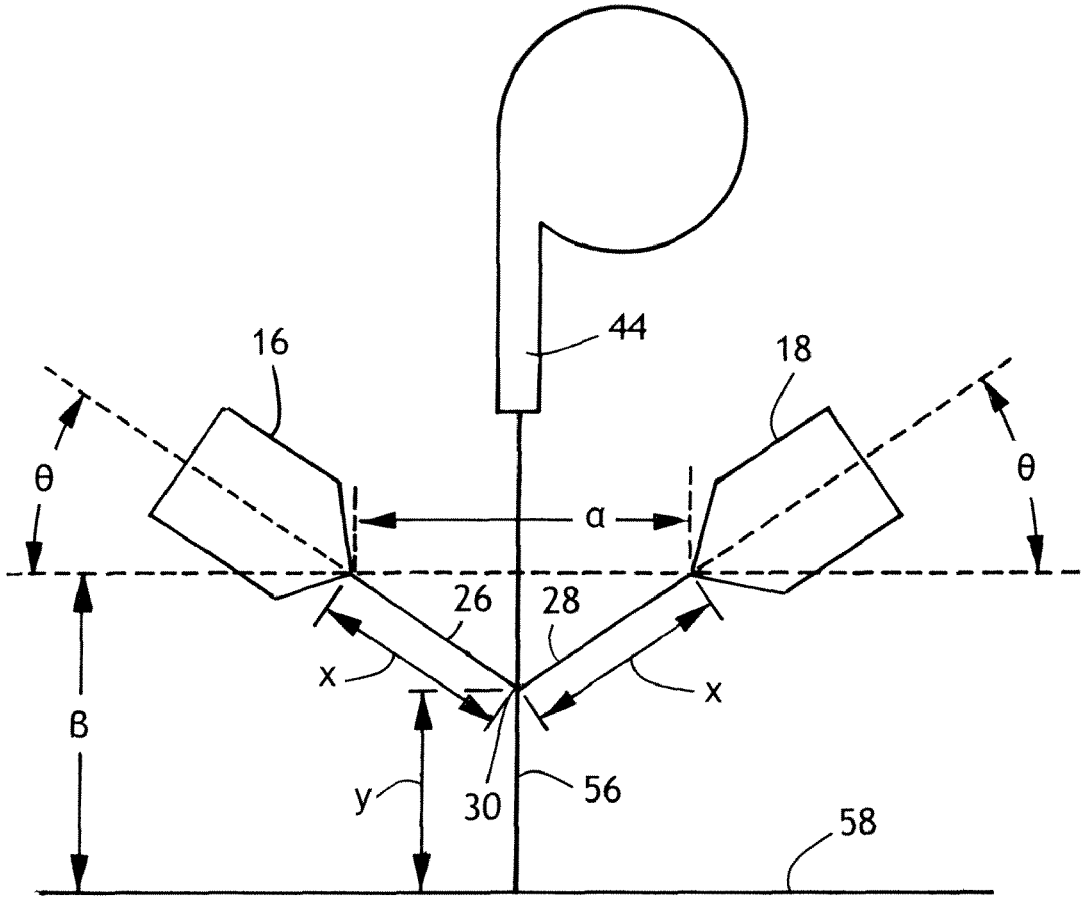
FIG. 2 illustrates an additional exemplary apparatus which may be utilized to produce the fibrous nonwoven structure.

Referring now to FIG. 2 of the drawings, there is shown a schematic diagram of an exemplary process described in FIG. 1. FIG. 2 highlights process variables which may affect the type of fibrous nonwoven structure made. Also shown are various forming distances which affect the type of fibrous nonwoven structure.

Utilization of the melt-blowing die as described in the exemplary aspects herein allow for improved formation and softness characteristics. The melt-blowing die arrangements 16 and 18 are mounted so they each can be set at an angle. The angle is measured from a plane that is parallel to the forming surface (e.g., the endless belt or wire 58). Typically, each die is set at an angle $\theta$ and mounted so that the primary air streams 26 and 28 of gas-borne fibers and microfibers produced from the dies intersect the formation zone 30. In some aspects, angle $\theta$ may range from about 30 to about 75 degrees. In other aspects, angle $\theta$ may range from about 35 to about 60 degrees. In still other aspects, angle $\theta$ may range from about 40 to about 55 degrees.

Meltblowing die arrangements 16 and 18 are separated by a distance $\alpha$. Generally speaking, distance $\alpha$ may range up to about 41 cm (16 in). In some aspects, $\alpha$ may range from about 13 cm (5 in) to about 25 cm (10 in). In other aspects, $\alpha$ may range from about 15 cm (6 in) to about 21 cm (8 in). Importantly, the distance $\alpha$ between the meltblowing dies and the angle $\theta$ of each meltblowing die determines location of the formation zone 30.

The distance from the formation zone 30 to the tip of each meltblowing die (i.e., distance X) should be set to minimize dispersion of each primary air stream 26 and 28 of fibers and microfibers. For example, this distance may range up to about 41 cm (16 in). Desirably, this distance should be greater than 6 cm (2.5 in). For example, for distances X in the range of about 6 cm (2.5 in) to 16 cm (6 in) the distance from the tip of each meltblowing die arrangement to the formation zone 30 can be determined from the separation between the die tips $\alpha$ and the die angle $\theta$ utilizing the formula:

$$X=\alpha/(2\cos\theta)$$

Generally speaking, the dispersion of the stream 56 may be minimized by selecting a proper vertical forming distance (i.e., distance $\beta$) before the stream 56 contacts the forming surface 58. $\beta$ is the distance from the meltblowing die tips 70 and 72 to the forming surface 58. A shorter vertical forming distance is generally desirable for minimizing dispersion. This must be balanced by the need for the extruded fibers to solidify from their tacky, semi-molten state before contacting the forming surface 58. For example, the vertical forming distance $\beta$ may range from about 7 cm (3 in) to about 38 cm (15 in) from the meltblown die tip. Desirably, this vertical distance $\beta$ may be about 10 cm (4 in) to about 28 cm (11 in) from the die tip.

An important component of the vertical forming distance $\beta$ is the distance between the formation zone 30 and the forming surface 58 (i.e., distance Y). The formation zone 30 should be located so that the integrated streams have only a minimum distance (Y) to travel to reach the forming surface 58 to minimize dispersion of the entrained fibers and microfibers. For example, the distance (Y) from the formation zone to the forming surface may range up to about 31 cm (12 in). Desirably, the distance (Y) from the impingement point to the forming surface may range from about 5 cm (3 in) to about 18 cm (7 in) inches. The distance from the formation zone 30 and the forming surface 58 can be determined from the vertical forming distance β, the separation between the die tips (β) and the die angle (θ) utilizing the formula:

$$Y=\beta-((\alpha/2)*\cos\theta)$$

Gas entrained secondary fibrous materials are introduced into the formation zone via a stream 34 emanating from a nozzle 44. Generally speaking, the nozzle 44 is positioned so that its vertical axis is substantially perpendicular to the forming surface.

In some situations, it may be desirable to cool the secondary air stream 34. Cooling the secondary air stream could accelerate the quenching of the molten or tacky meltblown fibrous materials and provide for shorter distances between the meltblowing die tip and the forming surface which could be used to minimize fiber dispersion. For example, the temperature of the secondary air stream 22 may be cooled to about 65 to about 85 degrees Fahrenheit.

By balancing the streams of meltblown fibers 26 and 28 and secondary air stream 34, the desired die angles θ of the meltblowing dies, the vertical forming distance (β), the distance between the meltblowing die tips (α), the distance between the formation zone and the meltblowing die tips (X) and the distance between the formation zone and the forming surface (Y), it is possible to provide a controlled integration of secondary fibrous materials within the meltblown fiber streams. Applicants have discovered that utilizing the exemplary die tips, below-wire exhaust box design, and separated high volume dilution and stripper air fans described herein allows for use of advantageous forming geometry and air stream volumes not previously possible, resulting in improved sheet characteristics.

The fibrous nonwoven structure of the different aspects may be provided on a single manufacturing line which includes multiple individual forming banks. Each forming bank is configured to provide an individual layer of the fibrous nonwoven structure. The mechanical entanglement between the fibers of each layer during the process provides attachment between the layers and may form bonds between the adjacent layers to provide the fibrous nonwoven structure. Subsequent thermomechanical bonding may also be used on the fibrous nonwoven structure to improve the attachment between the layers.

Desirably, the fibrous nonwoven structure may be used as a wet wipe which contains a liquid. The liquid can be any solution which can be absorbed into the wet wipe basesheet and may include any suitable components which provide the desired wiping properties. For example, the components may include water, emollients, surfactants, fragrances, preservatives, chelating agents, pH buffers or combinations thereof as are well known to those skilled in the art. The liquid may also contain lotions, medicaments, and/or other active agents.

The amount of liquid contained within each wet wipe may vary depending upon the type of material being used to provide the wet wipe, the type of liquid being used, the type of container being used to store the wet wipes, and the desired end use of the wet wipe. Generally, each wet wipe can contain from about 150 to about 600 weight percent and desirably from about 250 to about 450 weight percent liquid based on the dry weight of the wipe for improved wiping. In a particular aspect, the amount of liquid contained within the wet wipe is from about 300 to about 400 weight percent based on the dry weight of the wet wipe. If the amount of liquid is less than the above-identified ranges, the wet wipe may be too dry and may not adequately perform. If the amount of liquid is greater than the above-identified ranges, the wet wipe may be oversaturated and soggy and the liquid may pool in the bottom of the container.

Each wet wipe may be generally rectangular in shape and may have any suitable unfolded width and length. For example, the wet wipe may have an unfolded length of from about 2.0 to about 80.0 centimeters and desirably from about 10.0 to about 25.0 centimeters and an unfolded width of from about 2.0 to about 80.0 centimeters and desirably from about 10.0 to about 25.0 centimeters. Typically, each individual wet wipe is arranged in a folded configuration and stacked one on top of the other or a continuous strip of material which has perforations to provide a stack of wet wipes. The stack of wet wipes may be placed in the interior of a container, such as a plastic tub, and arranged in a stack for dispensing to provide a package of wet wipes for eventual sale to the consumer.

To produce the fibrous nonwoven structure disclosed herein, various aspects of the process were improved. Use of die tips with a smaller machine direction width, newly designed below-wire exhaust system and higher airflow, the separate stripper and dilution air fans, higher levels of dilution air, and optimized forming geometries are improved process components. Use of these novel process components and forming geometries provides physical improvements to the fibrous nonwoven structure, including improvements to softness, formation, opacity, fiber diameter, anisotropy, lint amount and tensile strength. These improvements may be utilized as product quality improvements at standard rates of production or rate improvements at standard quality levels, or some combination thereof.

Test Methods

Formation Index test:

The formation index is a ratio of the contrast and size distribution components of the nonwoven substrate. The higher the formation index, the better the formation uniformity. Conversely, the lower the formation index, the worse the formation uniformity. The "formation index" is measured using a commercially available PAPRICAN Micro-Scanner Code LAD94, manufactured by OpTest Equipment, Incorporated, utilizing the software developed by PAPRICAN & OpTest, Version 9.0, both commercially available from OpTest Equipment Inc., Ontario, Canada. The PAPRICAN Micro-Scanner Code LAD94 uses a video camera system for image input and a light box for illuminating the sample. The camera is a CCD camera with 65 μm/pixel resolution.

The video camera system views a nonwoven sample placed on the center of a light box having a diffuser plate. To illuminate the sample for imaging, the light box contains a diffused quartz halogen lamp of 82V/250 W that is used to provide a field of illumination. A uniform field of illumination of adjustable intensity is provided. Specifically, samples for the formation index testing are cut from a cross direction width strip of the nonwoven substrate. The samples are cut into 101.6 mm (4 inches) by 101.6 mm (4 inches) squares, with one side aligned with the machine direction of the test material. The side aligned with the machine direction of the test material is placed onto the testing area and held in place by the specimen plate with the machine direction pointed towards the instrument support arm that holds the camera. Each specimen is placed on the light box such that the side of the web to be measured for uniformity is facing up, away from the diffuser plate. To determine the formation index, the light level must be adjusted to indicate MEAN LCU GRAY LEVEL of 128±1.

The specimen is set on the light box between the specimen plate so that the center of the specimen is aligned with the center of the illumination field. All other natural or artificial room light is extinguished. The camera is adjusted so that its optical axis is perpendicular to the plane of the specimen and so that its video field is centered on the center of the specimen. The specimen is then scanned and calculated with the OpTest Software.

Fifteen specimens of the nonwoven substrate were tested for each sample and the values were averaged to determine the formation index.

Lint Count Test:

The lint count test is used to quantify the amount of lint liberated from a dry nonwoven basesheet. The test uses a strip of felt that is rubbed against the nonwoven basesheet 25 times and then analyzed with software to determine the amount of lint left on the felt. An ink rub tester, Digital Ink Rub Tester (DIRT) Model number 10-18-01, commercially available from Testing Machines, Inc., Ronkonkoma, N.Y., was used to rub a weighted felt strip against the nonwoven specimen. The DIRT consists of a test block, a specimen base, and a control unit.

The test block is an aluminum plate having a width of 50.8 mm (2 inches) and a length of 101.6 mm (4 inches). The test block is approximately 25.4 mm (1 inch) thick. The bottom of the test block is covered with an open cell Neoprene rubber pad, part number 10-18-04 commercially available from Testing Machines, Inc., Ronkonkoma, N.Y., 32 mm (⅛ inch) thick with compressibility such that 172±34 kPa (25 psi) shall compress the pad to half of its original thickness. This prevents the felt from sliding against the block during testing. Cut into the top of the test block are attachment areas. The attachment areas are two 13 mm wide, 10 mm deep stripe opening in the top of the test block across the length of the test block approximately 3 mm from the shorter edge. A piece of felt that is 1/16 inch thick is cut into a strip 50.8 mm (2 inches) by 152.4 mm (6 inches). No. F-55 felt commercially available from New England Gasket, Bristol, Conn., or any equivalents thereof may be used. The felt strip is attached to the test block at the attachment areas using large IDL binder clips. The total weight of the test block including IDL binder clips and rubber pad is 2.0 lb (908 g), resulting in 0.25 psi being applied to the felt strip when placed against the sample. Attached to the back at the middle of the length of the test block is an integrated hook. The integrated hook has a width of 21 mm and a length of 18 mm. At the bottom of the test block, the integrated hook has an opening 8 mm wide and 10 mm deep having a curved bottom approximately 6 mm from the edge of the plate that engages with the drive assembly on the control unit. The test block is engaged to the drive assembly of the control unit via the integrated hook.

The specimen base is covered with the open-cell Neoprene rubber pad material identified above. The pad helps prevent the specimen from sliding on the base during testing. The 7"×7" specimen is laid flat, wire-side down on the rubber pad and held in place using strong magnets or any other suitable clamping mechanism. The specimen is oriented so the machine direction (MD) is parallel to the direction of rubbing.

Per the manufacturer, the test block is "moved through an arc of 2.25 [inches] . . . a predetermined number of cycles, at a predetermined speed . . . "(See *TMI* 10-18-01 *Ink Rub Tester manual*, Rev 2, Pg 4.)

A sample of the nonwoven substrate is prepared by cutting a 177.8 mm (7 inch) by 177.8 mm (7 inch) square that is place onto the bed of the ink tester. Weights are placed on the edge of the sample to hold the sample in place. The DIRT was programmed to perform 25 cycles at a rate of 85 cycles per minute. The length of the stroke was not adjustable. Neither the sample nor the felt was heated before or during rubbing. The felt strip is removed from the test block and the side that was against the nonwoven specimen is measured for lint count. The image analysis measurement is done on images of the felt which were generated by a desktop scanner. A Canoscan 8800F desktop scanner is used to generate images of the rubbed felt strip. In order to accommodate up to three strips at a time, a gray-scale image measuring 9"×6.5" is scanned at a resolution of 300 dpi. The felt strips are placed on the scanner with the rubbed-side down and covered with a larger piece of felt to create a black background.

The lint count is then determined using the lint count software which is programmed in Visual Basic. The image analysis algorithm uses imaging libraries GdPicturePro v5 commercially available from GDPicture Imaging SDK of Toulouse, France and IMAQ v8.6 commercially available from National Instruments Corporation of Austin, Tex. The algorithm used to determine the lint count is illustrated below. Six specimens of the nonwoven substrate were tested for each sample and the values were averaged to determine the lint count.

```
Imports System.IO
Imports System.Text
Imports CWAnalysisControlsLib


Public Class frmSetup
   Inherits System.Windows.Forms.Form

#Region "Variable Declarations"

   Private dlgImage As New CWIMAQImageDialog
   'Private oGenFunc As New GenFunc
   Private mbOKtoScan As Boolean = False
   Private mbScanHideUI As Boolean = True
   Private mbScanProgressBar As Boolean = True
   Private mdblScanBottom As Double = 9.0
   Private mdblScanLeft As Double = 0.0
   Private mdblScanRight As Double = 9.0
   Private mdblScanTop As Double = 1.0
   Private mintNumSPecimen As Int16 = 0
   Private mintNumToMeasure As Int16 = 3
   Private mlngScanBrightness As Long = 0
   Private mlngScanContrast As Long = 0
   Private mlngScanResolution As Long = 300
   Private mdtData As DataTable
   Private mdtSummary As DataTable
   Private mstrDataPath As String

   Private mniPartRept As New CWIMAQFullParticleReport

#End Region 'Variable Declarations

   Private Sub btnFinish_Click(ByVal sender As System.Object, ByVal e As System.EventArgs) Handles
btnFinish.Click

      Dim iFile As Integer
      Dim iCt As Integer
      Dim jCt As Integer
      Dim strOut As String
      Dim strFN As String
      Dim oGenFuncs As New GenFunc

      Dim oResp As DialogResult = MessageBox.Show("Do you want to write the data to a .csv file?" &
vbCrLf & vbCrLf & _
            "Note: You will not be able to append data to the file.", "Finish Sample",
MessageBoxButtons.OKCancel)

      If oResp = Windows.Forms.DialogResult.OK Then
         strFN = txtSampleID.Text & " (" & txtTestDate.Text & " " & txtTestTime.Text & ").csv"
         strFN = oGenFuncs.FixFileName(strFN, "-")
         strFN = mstrDataPath & "\" & oGenFuncs.FixFilePath(strFN, " ")

         Try
            sbrText1.Text = "Saving data to " & strFN
            PrintTable(strFN)
            grdData.Columns.Clear()
            grdData.DataSource = Nothing
            mdtData = Nothing

            btnFinish.Visible = False
            btnMeasure.Visible = False
```

```
            btnCancel.Visible = False
            btnNewSample.Visible = True
            btnNewSample.Enabled = True
            txtUser.Text = ""
            txtSampleID.Text = ""
            txtTestTime.Text = ""
            txtTestDate.Text = ""
            sbrText1.Text = "Saving data complete"

        Catch oE As Exception

            MessageBox.Show(oE.Message.ToString)
            Exit Sub

        End Try

        '   With grdSummary

        '       For iCt = 0 To .Rows - 1
        '           strOut = vbNullString
        '           .Row = iCt

        '           For jCt = 0 To .Cols - 1
        '               .Col = jCt
        '               strOut = strOut & .Text & ","
        '           Next jCt

        '       Print #iFile, strOut
        '       Next iCt

        '   End With

        'Close #iFile
        '   txtSampleID.Text = vbNullString
        '   txtUser.Text = vbNullString
        '   txtTestDate.Text = vbNullString
        '   txtTestTime.Text = vbNullString
        '   cmdMeasure.Enabled = False
        '   cmdFinish.Enabled = False
        '   cmdCancel.Enabled = False
        '   cmdNewSample.Enabled = True
        '   mintNumSPecimen = 0
        '   grdData.Clear()
        '   grdSummary.Clear()

        '   FormatDataGrid()
        '   sbrStatus.SimpleText = "Data written to " & gstrDataPath & "\" & strFN & ".csv"
    End If

End Sub


Private Sub btnHeight_Click(ByVal sender As System.Object, _
                ByVal e As System.EventArgs)
    niCVwr.Height = Convert.ToInt32(InputBox("Height", , niCVwr.Height.ToString))

End Sub


Private Sub btnNewSample_Click(ByVal sender As System.Object, ByVal e As System.EventArgs)
Handles btnNewSample.Click
```

```
    Dim strSampleID As String
    Dim strUser As String
    Dim bCancel As Boolean

    strSampleID = InputBox("Sample ID: ", "Enter New Sample ID")

    If strSampleID = vbNullString Then bCancel = True

    If Not bCancel Then
      strUser = InputBox("User: ", "Enter Initials of User")
      If strUser = vbNullString Then bCancel = True
    End If

    If Not bCancel Then

      txtSampleID.Text = strSampleID
      txtUser.Text = strUser
      txtTestDate.Text = Today
      txtTestTime.Text = TimeOfDay()
      btnMeasure.Visible = True
      btnFinish.Visible = True
      btnCancel.Visible = True
      btnNewSample.Enabled = False
      mdtData = New DataTable
      mdtSummary = New DataTable

    End If

    sbrText1.Text = "Ready to measure"

  End Sub


  Private Sub btnTest_Click(ByVal sender As System.Object, ByVal e As System.EventArgs) Handles
btnTest.Click
    InitializeColumns()
    FormatDataView(72)
    FormatSummaryView(72)

    DummyUpData(11)
    grdData.SelectedCells(0).Selected = False
  End Sub


  Private Sub btnWidth_Click(ByVal sender As System.Object, _
                ByVal e As System.EventArgs)
    niCVwr.Width = Convert.ToInt32(InputBox("Width", , niCVwr.Width.ToString))

  End Sub


  Private Sub CreateMaskToolStripMenuItem_Click(ByVal sender As System.Object, ByVal e As
System.EventArgs) Handles CreateMaskToolStripMenuItem.Click
    Dim oRet As DialogResult
    Dim iCt As Integer
    Dim imgTemp As New CWIMAQImage
    Dim niThreshData As New CWIMAQMultiThresholdData
    Dim niClustering As New CWIMAQAutoThresholdMethods

    niClustering = CWIMAQAutoThresholdMethods.cwimaqATMethodCluster
```

```
    oRet = MessageBox.Show("Position the rubber template on the scanner, covered with white paper." & _
        vbCrLf & vbCrLf & "Press Ok to continue or Cancel to abort.", "Create Mask Image",
MessageBoxButtons.OKCancel)

    If oRet = Windows.Forms.DialogResult.OK Then

      Me.Cursor = Cursors.WaitCursor

      imgTemp = ScanImage()
      niCVwr.Regions.RemoveAll()
      niCVis.Copy(imgTemp, niCVwr.Image)
      niCVis.AutoThreshold2(niCVwr.Image, niCVwr.Image, 2, niClustering, niThreshData, imgTemp)

      niCVwr.Palette.Type = CWIMAQPaletteTypes.cwimaqPaletteBinary

      For iCt = 1 To 5
        niCVis.Morphology(niCVwr.Image, niCVwr.Image,
CWIMAQMorphOperations.cwimaqMorphErode)  'use default structuring element
      Next iCt

      For iCt = 1 To 2
        niCVis.Morphology(niCVwr.Image, niCVwr.Image,
CWIMAQMorphOperations.cwimaqMorphClose)  'use default structuring element
      Next iCt

      niCVis.FillHole(niCVwr.Image, niCVwr.Image, True)
      niCVis.RejectBorder(niCVwr.Image, niCVwr.Image, True)
      niCVis.WritePNGFile(niCVwr.Image, mstrDataPath & "\Mask image.png")
      btnMeasure.Enabled = MakeROIs()

      If btnMeasure.Enabled = False Then
        MsgBox("The mask image could not be created.", vbCritical)
      Else
        MsgBox("The mask was successfully created.")
        ShowROIs()
      End If

      Me.Cursor = Cursors.Default
    End If
  End Sub


  Private Sub FormatDataView(ByVal iSize As Int16)
    Dim iCt As Int16
    Dim iNumCols As Int16

    grdData.DataSource = mdtData
    iNumCols = grdData.ColumnCount

    For iCt = 0 To iNumCols - 1
      With grdData.Columns(iCt)
        .Width = iSize
        .DefaultCellStyle.Alignment = DataGridViewContentAlignment.MiddleRight
        .DefaultCellStyle.Format = "f"
      End With
    Next iCt

    grdData.Columns(0).DefaultCellStyle.Format = "d"
    grdData.Columns(3).DefaultCellStyle.Format = "d"
    grdData.RowHeadersVisible = False
    grdData.ScrollBars = ScrollBars.Vertical
```

```
    grdData.ColumnHeadersDefaultCellStyle.Alignment = DataGridViewContentAlignment.BottomRight
    grdData.Columns("Spec #").Width = 50
    grdData.Width = 484

  End Sub


  Private Sub FormatSummaryView(ByVal iSize As Int16)
    Dim iCt As Int16
    Dim iNumCols As Int16
    Dim jCt As Int16
    Dim rowDataS As DataRow
    Dim rndNumber As New Random
    Dim originalfont As Font = grdSummary.Font
    Dim newfont As New Font(originalfont, originalfont.Style)


    grdSummary.DataSource = mdtSummary
    iNumCols = grdSummary.ColumnCount

    For iCt = 0 To iNumCols - 1
      With grdSummary.Columns(iCt)
        .Width = iSize
        .DefaultCellStyle.Alignment = DataGridViewContentAlignment.MiddleRight
        .DefaultCellStyle.Format = "f"
      End With
    Next iCt
    grdSummary.Columns(0).DefaultCellStyle.Format = "string"

    grdSummary.Columns(3).DefaultCellStyle.Format = "d"
    grdSummary.RowHeadersVisible = False
    grdSummary.ColumnHeadersVisible = False
    grdSummary.ScrollBars = ScrollBars.None
    grdSummary.ColumnHeadersDefaultCellStyle.Alignment =
DataGridViewContentAlignment.BottomRight
    grdSummary.Columns(0).Width = 50
    grdSummary.Width = 484
    grdSummary.Height = 88

    For iCt = 1 To 4
      rowDataS = mdtSummary.NewRow()
      Select Case iCt

        Case 1
          rowDataS(0) = "Average"

        Case 2
          rowDataS(0) = "Stdev"

        Case 3
          rowDataS(0) = "% COV"

        Case 4
          rowDataS(0) = "Count"

      End Select
      mdtSummary.Rows.Add(rowDataS)
    Next
    'grdSummary.Columns(0).DefaultCellStyle.Font = newfont
    grdSummary.Columns(0).DefaultCellStyle.BackColor = Color.Azure
```

```
End Sub

Private Sub frmSetup_Load(ByVal sender As Object, _
                ByVal e As System.EventArgs) _
    Handles Me.Load

  gdImaging.SetLicenseNumber("151931282102813464060101 6")
  gdImaging.TwainLogStart(AppDomain.CurrentDomain.BaseDirectory & "\gdtwain.log")
  Me.btnNewSample.Enabled = MakeROIs()


  'read configuration settings
  mbScanHideUI = My.Settings.ScanHideUI
  mbScanProgressBar = My.Settings.ScanProgressBar
  mlngScanBrightness = My.Settings.ScanBrightness
  mlngScanContrast = My.Settings.ScanContrast
  mlngScanResolution = My.Settings.ScanResolution
  mdblScanTop = My.Settings.ScanTop
  mdblScanBottom = My.Settings.ScanBottom
  mdblScanLeft = My.Settings.ScanLeft
  mdblScanRight = My.Settings.ScanRight
  mstrDataPath = My.Settings.DataPath

  mbOKtoScan = gdImaging.TwainSelectSource()

  If mbOKtoScan Then
    sbrText1.Text = "Scanner: " & gdImaging.TwainGetDefaultSourceName()

  Else
    sbrText1.Text = "No scanner selected"
  End If

End Sub



Private Sub InitializeColumns()
  Dim iCt As Int16
  Dim column0 As New DataColumn("Spec #", GetType(Integer))
  Dim column1 As New DataColumn("% Area", GetType(Double))
  Dim column2 As New DataColumn("Brightness", GetType(Double))
  Dim column3 As New DataColumn("Count", GetType(Integer))
  Dim column4 As New DataColumn("Mean Area", GetType(Double))
  Dim column5 As New DataColumn("Mean Length", GetType(Double))
  Dim column6 As New DataColumn("AWM Length", GetType(Double))

  Dim column0s As New DataColumn("0", GetType(String))
  Dim column1s As New DataColumn("1", GetType(Double))
  Dim column2s As New DataColumn("2", GetType(Double))
  Dim column3s As New DataColumn("3", GetType(Integer))
  Dim column4s As New DataColumn("4", GetType(Double))
  Dim column5s As New DataColumn("5", GetType(Double))
  Dim column6s As New DataColumn("6", GetType(Double))

  mdtData.Reset()
  mdtData.Columns.Add(column0)
  mdtData.Columns.Add(column1)
  mdtData.Columns.Add(column2)
  mdtData.Columns.Add(column3)
  mdtData.Columns.Add(column4)
  mdtData.Columns.Add(column5)
```

```
    mdtData.Columns.Add(column6)

    mdtSummary.Reset()
    mdtSummary.Columns.Add(column0s)
    mdtSummary.Columns.Add(column1s)
    mdtSummary.Columns.Add(column2s)
    mdtSummary.Columns.Add(column3s)
    mdtSummary.Columns.Add(column4s)
    mdtSummary.Columns.Add(column5s)
    mdtSummary.Columns.Add(column6s)

  End Sub


  Private Sub InitScanConfig()
    Dim bError As Boolean = False

    'set default conditions
    gdImaging.TwainSetAutoBrightness(False)
    gdImaging.TwainSetCurrentPixelType(GdPicturePro5.TwainPixelType.TWPT_GRAY)
    gdImaging.TwainSetCurrentBitDepth(8)
    gdImaging.TwainSetXferCount(1)

    'set configured conditions
    gdImaging.TwainSetHideUI(mbScanHideUI)
    gdImaging.TwainSetIndicators(mbScanProgressBar)
    gdImaging.TwainSetCurrentResolution(mlngScanResolution)
    gdImaging.TwainSetCurrentContrast(mlngScanContrast)
    gdImaging.TwainSetCurrentBrightness(mlngScanBrightness)
    gdImaging.TwainSetImageLayout(mdblScanLeft, mdblScanTop, mdblScanRight, mdblScanBottom)

  End Sub


  Private Function MakeROIs() As Boolean

    'Makes three regions from the mask image stored as bounding
    'rectangles in a module-level particle report, which are ordered
    'by distance from top of image
    Dim regions As New CWIMAQRegions
    Dim imgTemp As New CWIMAQImage
    Dim iCt As Integer
    Dim file As FileInfo = New FileInfo(mstrDataPath & "\Mask Image.png")


    If file.Exists = True Then

      niCVis.ReadImage(imgTemp, mstrDataPath & "\Mask Image.png")

      For iCt = 1 To 20
        niCVis.Morphology(imgTemp, imgTemp, CWIMAQMorphOperations.cwimaqMorphErode)  'use
default structuring element
      Next iCt

      niCVis.Particle(imgTemp, mniPartRept)
      imgTemp = Nothing

      If mniPartRept.Count = 3 Then
        Return True
      Else
        Return False
```

```
        End If
      Else
        MessageBox.Show("The mask image could not be found. You will need to create a mask" & vbCrLf
& _
                "image before you can measure sample images.", "Error loading mask image")
        Return False
      End If

    End Function


    Private Sub OpenImageToolStripMenuItem_Click(ByVal sender As System.Object, _
                                ByVal e As System.EventArgs) _
        Handles OpenImageToolStripMenuItem.Click

      dlgImage.ShowOpen()

      If Len(dlgImage.FileName) > 1 Then
        'Read the file into the image attached to the viewer
        niCVis.ReadImage(niCVwr.Image, dlgImage.FileName)
        niCVwr.ZoomScale = -2
      End If

    End Sub


    Private Sub opt1Spec_CheckedChanged(ByVal sender As System.Object, _
                        ByVal e As System.EventArgs) _
        Handles opt1Spec.CheckedChanged

      If opt1Spec.Checked = True Then
        mintNumToMeasure = 1
      End If

    End Sub


    Private Sub opt2Spec_CheckedChanged(ByVal sender As System.Object, ByVal e As System.EventArgs)
Handles opt2Spec.CheckedChanged
      mintNumToMeasure = 2
    End Sub


    Private Sub opt3Spec_CheckedChanged(ByVal sender As System.Object, ByVal e As System.EventArgs)
Handles opt3Spec.CheckedChanged
      mintNumToMeasure = 3
    End Sub


    Private Sub PrintColumns(ByVal reader As DataTableReader, ByVal strFile As String)

      Try
        ' Loop through all the rows in the DataTableReader.
        Do While reader.Read()
          Using fs As New FileStream(strFile, FileMode.Append)
            Using w As New StreamWriter(fs, Encoding.UTF8)
              For i As Integer = 0 To reader.FieldCount - 1
                w.Write(",," & reader(i).ToString())
              Next
              w.WriteLine()
            End Using
```

```
        End Using
      Loop

    Catch oE As System.Exception
      MessageBox.Show(oE.Message.ToString)
    End Try

End Sub


Private Sub PrintTable(ByVal strFile As String)

    'print header info
    Try
      Using fs As New FileStream(strFile, FileMode.Create)
        Using w As New StreamWriter(fs, Encoding.UTF8)
          w.WriteLine("Sample ID:, " & txtSampleID.Text)
          w.WriteLine("User ID:, " & txtUser.Text)
          w.WriteLine("Test date:, " & txtTestDate.Text)
          w.WriteLine("Test time:, " & txtTestTime.Text)
          w.WriteLine()
          w.WriteLine(",Specimen,% Area,Brightness,Count,Mean Area, Mean Length, AWM Length")
        End Using
      End Using
      ' Create the new DataTableReader.
      Using reader As New DataTableReader(New DataTable() {mdtData})

        ' Print the contents of each of the result sets.
        Do
          PrintColumns(reader, strFile)
        Loop While reader.NextResult()
      End Using

    Catch oE As Exception
      MessageBox.Show(oE.Message.ToString)

    End Try


End Sub


Private Sub SaveImageToolStripMenuItem_Click(ByVal sender As System.Object, _
                                             ByVal e As System.EventArgs) _
      Handles SaveImageToolStripMenuItem.Click

    Dim dlgSave As New SaveFileDialog
    Dim optJPG As New CWIMAQJPEGFileOptions
    dlgSave.Filter = "JPEG Files (*.jpg)|*.jpg"
    dlgSave.InitialDirectory = Application.StartupPath & "\Images"

    If dlgSave.ShowDialog = Windows.Forms.DialogResult.OK Then
      optJPG.Quality = 1000
      niCVis.WriteJPEGFile(niCVwr.Image, dlgSave.FileName, optJPG)
    End If

End Sub


Private Function ScanImage() As CWIMAQImage
```

```
    Dim lngImageID As Long
    Dim imgTemp As New CWIMAQImage

    sbrText1.Text = "Connecting to source..."
    System.Windows.Forms.Application.DoEvents()

    If gdImaging.TwainOpenDefaultSource() Then
      sbrText1.Text = "Acquiring from " & gdImaging.TwainGetDefaultSourceName & "..."
      Me.Cursor = Cursors.WaitCursor
      InitScanConfig()
      lngImageID = gdImaging.CreateImageFromTwain(Me.Handle.ToInt32)

      If lngImageID <> 0 Then
        Call gdImaging.SaveAsJPEG(mstrDataPath & "\acquire.jpg", 100)
        Call gdImaging.CloseImage(lngImageID)
        niCVis.ReadImage(imgTemp, mstrDataPath & "\acquire.jpg")
      End If

      System.Windows.Forms.Application.DoEvents()

      sbrText1.Text = "Loading image..."
      niCVwr.Palette.Type = CWIMAQPaletteTypes.cwimaqPaletteGrayScale
      niCVwr.ZoomScale = -2
      Me.Cursor = Cursors.Default
      gdImaging.TwainCloseSource()
      sbrText1.Text = "Ready"
      Return imgTemp

    Else
      MessageBox.Show("Can't open default source, twain state is: " &
Trim(Str(gdImaging.TwainGetState)))
      sbrText1.Text = "Image not scanned. An error occurred."
    End If

  End Function


  Private Sub ScanImageToolStripMenuItem_Click(ByVal sender As System.Object, _
                                ByVal e As System.EventArgs) _
      Handles ScanImageToolStripMenuItem.Click

    Dim imgTemp As New CWIMAQImage
    niCVwr.Palette.Type = CWIMAQPaletteTypes.cwimaqPaletteGrayScale
    niCVwr.ZoomScale = -2
    imgTemp = ScanImage()
    niCVis.Copy(imgTemp, niCVwr.Image)
    Me.Cursor = Cursors.Default
    imgTemp = Nothing

  End Sub


  Private Sub SelectSourceToolStripMenuItem_Click(ByVal sender As System.Object, _
                                ByVal e As System.EventArgs) _
      Handles SelectSourceToolStripMenuItem.Click
    mbOKtoScan = gdImaging.TwainSelectSource()

  End Sub


  Private Sub ShowROIs()
```

```
    Dim iCt As Integer

    niCVwr.Regions.RemoveAll()

    For iCt = 1 To 3
      niCVwr.Regions.AddRectangle(mniPartRept.Item(iCt).BoundingRectangle)
    Next iCt

  End Sub


  Private Sub ShowROIsToolStripMenuItem_Click(ByVal sender As System.Object, ByVal e As
System.EventArgs) Handles ShowROIsToolStripMenuItem.Click

    ShowROIs()

  End Sub


  Private Sub grdData_CellContentDoubleClick(ByVal sender As Object, ByVal e As
System.Windows.Forms.DataGridViewCellEventArgs) Handles grdData.CellContentDoubleClick
    Dim oRet As DialogResult
    Dim dr As DataRow
    Dim i As Int16


    If grdData.Rows.Count > 0 Then
      oRet = MessageBox.Show("Are you sure you want to delete specimen " &
grdData.Rows(e.RowIndex).Cells(0).Value.ToString() & "?", "Confirm row delete",
MessageBoxButtons.YesNo)

      If oRet = Windows.Forms.DialogResult.Yes Then
        dr = mdtData.Rows(e.RowIndex)
        dr.Delete()
        mdtData.AcceptChanges()
        i = 1
      End If
    End If



  End Sub


  Private Sub grdData_RowsAdded(ByVal sender As Object, ByVal e As
System.Windows.Forms.DataGridViewRowsAddedEventArgs) Handles grdData.RowsAdded

    ResizeDataGrid()

  End Sub


  Private Sub CalculateStats()
    Dim arrData() As Double
    Dim iCt As Int16
    Dim jCt As Int16
    Dim dblMean As Double
    Dim dblStdev As Double

    ReDim arrData(mdtData.Rows.Count - 1)
```

```
    Try
      For iCt = 1 To 6
        For jCt = 0 To mdtData.Rows.Count - 1
          If Not ((mdtData.Rows(jCt).RowState = DataRowState.Detached) Or
(mdtData.Rows(jCt).RowState = DataRowState.Deleted)) Then
            arrData(jCt) += mdtData.Rows(jCt)(iCt)
          End If
        Next jCt
        dblMean = NationalInstruments.Analysis.Math.Statistics.Mean(arrData)
        dblStdev = NationalInstruments.Analysis.Math.Statistics.StandardDeviation(arrData)
        mdtSummary.Rows(0)(iCt) = dblMean
        mdtSummary.Rows(1)(iCt) = dblStdev
        mdtSummary.Rows(2)(iCt) = dblStdev * 100.0 / dblMean
        Array.Clear(arrData, 0, mdtData.Rows.Count)
      Next iCt

    Catch ex As Exception
      MessageBox.Show(ex.InnerException.Message.ToString)

    End Try

    jCt = 0
  End Sub


  Private Sub grdSummary_SelectionChanged(ByVal sender As Object, ByVal e As System.EventArgs)
Handles grdSummary.SelectionChanged

    If grdSummary.SelectedCells.Count > 0 Then
      grdSummary.SelectedCells(0).Selected = False
    End If

  End Sub

  Private Sub grdData_RowsRemoved(ByVal sender As Object, ByVal e As
System.Windows.Forms.DataGridViewRowsRemovedEventArgs) Handles grdData.RowsRemoved

    ResizeDataGrid()

  End Sub

  Private Sub ResizeDataGrid()

    If grdData.Rows.Count > 10 Then
      grdData.Width = 501
    Else
      grdData.Width = 484
    End If

    If mdtData.Rows.Count > 1 Then
      CalculateStats()
    End If
  End Sub
End Class
```

Surface Roughness Test:

Surface roughness is measured using a commercially available FRT MicroProf 200 non-contact optical profiler from Fries Research and Technology GmbH, Bergisch Gladbach, Germany. The optical system provides a stationary white light probe of a few microns spot size which impinges onto the sample directly from above. The sample is mechanically scanned under the probe via a computer-controlled stage. Reflections are collected coaxially, the wavelength of the reflection at each point is measured by a spectrophotometer and converted to a z-value. After the raw topographic data is collected, it is filtered to remove the "invalid" points which are points of zero reflection (voids).

Surface maps are generated by placing a nonwoven sheet cut to a 7" by 7" square on the horizontal surface of a motor controlled X-Y table. The profilometer records height (z) for an array of horizontal positions (X & Y), which is accomplished by moving the X-Y table, such that the sheet elevations within an area of interest are measured by a fixed optical detector mounted vertically above the sheet.

The FRT MicroProf non-contact optical profiler was operated under the following conditions:

a. Optical sensor with a 300 μm vertical detection range per layer
b. Number of stacked layers: 3 to 5 layers (=750 μm-1250 μm total vertical range), varies, depending on the surface relief of a given sample
c. Detector frequency: 30 Hz
d. Number of specimens: 5
e. Number of maps per specimen: 4 (2 maps from the air side, 2 maps from the wire side for a total of 10 air side maps and 10 wire side maps per sample)
f. Map size: 20 mm by 20 mm square area
g. Number of lines per map: 10 equally spaced 20 mm long traces (Y-direction lateral resolution=2 millimeters)
h. Number of data points per line: 250 (X-direction lateral resolution=80 micrometers)

The following parameters were calculated from the processed data. The data was processes using the FRT Mark III version 3.7 software. This software, which processes the data and calculates the two parameters SWa and SWz, is based on "standard" documents: ISO 4287, ASME B46.1 and ISO 11562. All data (maps) are "waviness filtered", meaning that the surfaces have been filtered to remove high frequency elements and retain lower frequency (longer wavelength) elements, in order to emphasize the larger scale, undulating or waviness texture. This is accomplished by subdividing the area into a series of "cutoff areas". The waviness parameter is an average of all cutoffs. For this analysis the cutoff (Lc)=2 mm.

a. SWa (average roughness) is the arithmetic mean deviation of the measured surface from the mean plane.
b. SWz (10-point height of the surface) is an average of the difference between the five highest peaks and the five lowest depressions in the measurement area and is a measure of the total relief.
c. "S" denotes a surface
d. "W" denotes a surface that has been filtered to remove high frequency elements and retain lower frequency (longer wavelength) elements, in order to emphasize the larger scale, undulating or waviness texture
e. "a" is the standard notation for roughness or average deviation from a mean line or plane
f. "z" is the standard notation for the maximum deviation from a mean line or plane over the assessment length or area Tensile Strength Test:

For purposes herein, tensile strength may be measured using a Constant Rate of Elongation (CRE) tensile tester using a 3-inch jaw width (sample width), a test span of 2 inches (gauge length), and a rate of jaw separation of 25.4 centimeters per minute after maintaining the sample at the ambient conditions of 23±2° C. and 50±5% relative humidity for 4 hours before testing the sample at the same ambient conditions. The "MD tensile strength" is the peak load in grams-force per 3-inches of sample width when a sample is pulled to rupture in the machine direction.

More particularly, samples for tensile strength testing are prepared by cutting a 76±1 mm (3±0.04 inch) wide by at least 101±1 mm (4±0.04 inch) long strip in the machine direction (MD) orientation using a JDC Precision Sample Cutter commercially available from Thwing-Albert Instrument Company, Philadelphia, Pa., Model No. JDC 3-10, Serial No. 37333. The instrument used for measuring tensile strength is an MTS Systems Sintech 1/G model. The data acquisition software is MTS TestWorks® for Windows Ver. 4.0 commercially available from MTS Systems Corp., Eden Prairie, Minn. The load cell is an MTS 25 Newton maximum load cell. The gauge length between jaws is 2±0.04 inches (50±1). The top and bottom jaws are operated using pneumatic-action with maximum 90 P.S.I. (i.e. Instron Corporation, 2712-003 or equivalent). The grip faces are rubber coated with a grip face width of 3 inches (76.2 mm), and height of 1 inch (25.4 mm) (i.e. Instron Corporation 2702-035 or equivalent). The break sensitivity is set at 40%. The data acquisition rate is set at 100 Hz (i.e. 100 samples per second). The sample is placed in the jaws of the instrument, centered both vertically and horizontally. The test is then started and ends when the force drops by 40% of peak. The peak load expressed in grams-force is recorded as the "MD tensile strength" of the specimen. At least twelve representative specimens are tested for each product and its average peak load is determined.

Opacity Test:

The opacity measures the level of light that is prevented from being transmitted through a test specimen composite. In particular, the opacity of the sample is measured by a "contrast-ratio" method using Hunter Lab model D25 with a DP-9000 processor equipped with the A sensor (commercially available from Hunter Associates Laboratory, Restor, Va.). The Y value of the specimen backed by the black tile is divided by the Y value of the specimen backed by the white tile. The resulting fraction is opacity. Y represents the black and white scale or lightness scale of the tristimulus values. The A sensor has a specimen port area of 2 inches (51 mm) in diameter. The specimen is illuminated, the illuminated area being slightly smaller than the port opening.

The illumination of D25 with DP-9000 system is in reference to CIE (International Commission on Illumination) 2° Observer and Illuminant C. The light source is from the quartz halogen cycle lamp (between 8.5 and 10.5 volts) directed at the specimen at an angle of 45 degrees from the perpendicular. The reflected light is then collected in a receptor located directly above (or below, depending on the orientation of the sensor) the specimen at 0 degree from the perpendicular. The electrical signals in the receptor are then directed to the processor. The calibrated standard black and white tiles of series no. 90671 are available from Hunter Associates Laboratory. Six specimens of the nonwoven substrate of size of 4"×4" were tested for each sample and the values were averaged to determine the opacity level.

Polymeric Fiber Diameter, Polymeric Volume Weighted Diameter and Anisotropy Test:

Polymeric fiber diameter, polymeric volume weighted diameter and anisotropy may be measured using an image analysis system.

Specimens are left to equilibrate at laboratory conditions of less than 60% relative humidity for at least 24 hours. Six small squares (approx. 2 cm×2 cm) are randomly cut from six different regions for each specimen, and any sidedness (e.g. wire vs. air side) and directionality (e.g. machine vs. cross-machine direction) are noted on each square for tracking. For example, squares are cut so that side edges align with machine and cross-machine directions and a notch is cut out of one of the square's corners to track sidedness and directionality. Any machine-produced embossment regions or other similar artifacts should also be avoided when cutting out square pieces. Specimen pieces are then treated with a 75% sulfuric acid solution to dissolve and remove the cellulosic components. The solution is made up from commercial grade concentrated sulfuric acid which is diluted in volumetric ratios of 75 parts acid and 25 parts water. Treatment is performed by filling three petri dishes with the acid solution and soaking each specimen piece for 20 minutes in each dish, progressing from first to last for a total of 60 minutes of soaking time. Treated specimens are thoroughly rinsed with de-ionized water (approximately 50 mL or more per specimen square), examined to ensure no cellulose remains, and left to dry until equilibrium has been reached with the less than 60% relative humidity laboratory conditions.

Specimen squares are trimmed and mounted on to a secondary electron microscope (SEM) stub so that the wire side is facing up. Directionality of specimens should also be taken into consideration during the mounting process. More specifically, mounting should be performed so that the machine-direction of the material will run vertically in the image when it is subsequently acquired for measurements. Basic mounting techniques should be apparent to one skilled in the art of SEM microscopy.

After specimens are mounted on appropriate SEM stubs, the specimen is sputter coated with gold via a Denton Vacuum Desk II Cold Sputter Etch Unit, Serial #13357 (Cherry Hill, N.J.). Gold is applied in six, 10 second bursts at 40 microamps for a total of 1 minute of gold deposition. Approximately 10 to 20 nanometers of gold thickness should be targeted. The exact method of coating will depend on the sputter coater used, but one skilled in the art should be able to obtain a sufficient coating thickness for SEM imaging.

A JEOL Model JSM-6490LV SEM (Tokyo, Japan) equipped with a solid state backscatter detector is used to acquire digital back-scatter electron/high-contrast (BSE/HICON) images. A clear, sharp image is required. Several parameters known to those skilled in the art of SEM microscopy must be properly adjusted to produce such an image. Parameters could include accelerating voltage, spot size, working distance and magnification. The following settings are used:

a. Working Distance (WD)=15 mm
b. Accelerating voltage—10 kV
c. Spot Size—58 at 1280×960 pixel resolution
d. Magnification—Use the 1% rule (i.e., smallest fibers should possess a pixel diameter of at least as wide as 1% of the field-of-view size in one dimension) to approximate the magnification. One may need to view a few different surface regions to determine this. Once the magnification is determined, it must be kept constant for all images of a single sample.
e. Brightness and contrast are adjusted to maintain the edges of crossing fibers that are in the same plane of focus
f. Images are binarized using an ImageJ (formerly NIH Image) macro to reset pixel gray-level intensity values of 128 and above to 255. Pixel values below 128 are reset to 0. The images are 8-bit where 0 is 'black' and 255 'white.'
g. A calibration factor is determined by digitally imaging an Agar Scientific Ltd. S1930 Silicon Test Specimen Certified Specimen No. A877 at each magnification and calculating the calibration factor directly.

Six digital BSE/HICON surface SEM images, one acquired from each of the six specimen pieces, are downloaded directly onto the hard drive of the host computer possessing the image analysis software system and analysis algorithm. The system and algorithm can read the images, perform detection and image processing steps and finally acquire measurements. Said system and algorithm also accumulate data into histograms and provide digital data output.

Fiber diameter and anisotropy data are acquired from the surface BSE/HICON images using Leica Microsystems, Heerbrugg, Switzerland, QWIN Pro v. 3.2.1 software as the image analysis platform. In particular, an algorithm 'MB Diameter—1' is used in performing this work.

The accuracy of the SEM imaging parameters described above can be checked by using a reference material such as a mesh used in a standard sieve. Based off of ASTM Specification E-11, a No. 435 sieve provides a nominal wire diameter of 28 um+/−15%. A small portion of such a sieve's, or another comparable sieve (e.g. nos. 400, 500, and 635), wire mesh could be mounted and imaged in an SEM to obtain BSE/HICON images which could then be analyzed using the image analysis algorithm. SEM settings should be adjusted until the wire diameter value falls within the nominal wire diameter range, Sieves can be purchased from W. S. Tyler Inc., Mentor, Ohio.

Anisotropy, also referred to as the fiber matrix orientation, is a field-based measurement that is performed on an entire image rather than individual fiber segments. Each of the six images acquired per specimen yielded its own anisotropy measurement value.

In addition to measuring a count-weighted fiber diameter distribution for each image, a volume-weighted distribution is also calculated by assuming a cylindrical fiber shape. The ratio of the volume/count-weighted mean values obtained from histograms can be calculated to elucidate differences between the distributions of different specimens.

Both count and volume-weighted data are acquired into histogram formats for each type of distribution. The histograms possess statistical data as well, such as mean, standard deviation, count, fiber segment length, volume, maximum, minimum, etc. Data is electronically transferred to a Microsoft® EXCEL® spreadsheet via the image analysis algorithm 'MB Diameter—1.' A Student's T analysis is performed on the data at the 90% confidence level in order to elucidate any differences between samples. Each image is considered a single sampling point from which multiple (e.g. >400 fiber segments) measurements are performed. A total of six images are analyzed per specimen for n=6. The six average values obtained from the histograms acquired from each image are averaged to determine the fiber diameter. The six anisotropy measurements are also averaged and processed using the Student's T analysis.

Image Analysis Algorithm

```
NAME = MB Diameter – 1
PURPOSE = Measure diameter of MB fibers from digital images acquired via Jeol SEM
          Data to EXCEL - no printouts
CONDITIONS = SEM images electronically read via QWIN Pro v. 3.2.1 software platform
ACQOUTPUT = 0
CALVALUE = 0.13
IMAGE = 0
DUMBY = 0
OPEN DATA STORAGE FILES
Open File ( C:\Data\14481\length-wt.xls, channel #1 )
Open File ( C:\Data\14481\volume-wt.xls, channel #2 )
Configure ( Image Store 1280 × 960, Grey Images 96, Binaries 24 )
Enter Results Header
File Results Header ( channel #1 )
File Line ( channel #1 )
File Line ( channel #1 )
File Results Header ( channel #2 )
File Line ( channel #2 )
File Line ( channel #2 )
Calibrate ( CALVALUE CALUNITS$ per pixel )
Image frame ( x 0, y 0, Width 1280, Height 960 )
Measure frame ( x 31, y 61, Width 1218, Height 898 )
SETUP:
For ( SAMPLE = 1 to 6, step 1 )
Clear Feature Histogram #2
Clear Feature Histogram #4
Clear Feature Histogram #3
TOTANISOT = 0
TOTSURVOL = 0
TOTFIELDS = 0
For ( FIELD = 1 to 1, step 1 )
IMAGE ACQUISITION & PROCESSING
IMAGE = IMAGE+1
ACQFILE$ = "C:\Images\14481\Surface\7768_14s_"+STR$(IMAGE)+"_s.TIF"
Read image ( from file ACQFILE$ into ACQOUTPUT )
Display ( Image0 (on), frames (on,on), planes (off,off,off,off,off,off), lut 0, x 0, y 0, z 1, Reduction off )
Grey Transform ( FillWhite from Image0 to Image2, cycles 2, operator Octagon )
Detect ( whiter than 135, from Image2 into Binary0 delineated )
Binary Amend ( White Exh. Skeleton from Binary0 to Binary1, cycles 1, operator Disc, edge erode on, alg.
'L' Type )
Binary Amend ( Prune from Binary1 to Binary2, cycles 25, operator Disc, edge erode on )
Binary Identify ( Remove White Triples from Binary2 to Binary3 )
Binary Amend ( Prune from Binary3 to Binary4, cycles 16, operator Disc, edge erode on )
Binary Amend ( Dilate from Binary4 to Binary5, cycles 0, operator Disc, edge erode on )
Binary to Grey ( Distance from Binary0 to Image1, operator Octagon )
Display ( Image1 (on), frames (on,on), planes (off,off,off,off,off,off), lut 0, x 0, y 0, z 1, Reduction off )
MFEATINPUT = 0
FERETS = 0
MINAREA = 0
FTRGREY.IMAGE = 0
FIBER DIAMETER MEASUREMENT
Clear Accepts
Measure feature ( plane Binary5, 8 ferets, minimum area: 4, grey image: Image1 )
  Selected parameters: X FCP, Y FCP, Length, UserDef1, UserDef2, MeanGrey, UserDef3,
  UserDef4
Feature Expression ( UserDef1 ( all features ), title PXWIDTH = PMEANGREY(FTR)*2 )
Feature Expression ( UserDef2 ( all features ), title FIBWIDTH1 = (PMEANGREY(FTR)*2)*CALVALUE
)
Feature Expression ( UserDef3 ( all features ), title PXLENGTH = PLENGTH(FTR)/CALVALUE )
Feature Expression ( UserDef4 ( all features ), title Cylind Vol. =
((3.1416*((PMEANGREY(FTR)*CALVALUE)**2))*PLENGTH(FTR))/10000 )
Display ( Image1 (on), frames (on,on), planes (off,off,off,off,off,off), lut 0, x 0, y 0, z 1, Reduction off )
Feature Accept:
      UserDef1 from 2. to 10000000.
      UserDef3 from 4. to 10000000.
Feature Histogram #2 ( Y Param Length, X Param UserDef2, from 0.1000000015 to 100., logarithmic, 20
bins )
Feature Histogram #3 ( Y Param UserDef4, X Param UserDef2, from 0.1000000015 to 100., logarithmic, 20
bins )
Feature Histogram #4 ( Y Param Number, X Param UserDef2, from 0.1000000015 to 100., logarithmic, 20
bins )
Feature Histogram #5 ( Y Param Length, X Param UserDef2, from 0.1000000015 to 100., logarithmic, 20
bins )
Display ( Image1 (on), frames (on,on), planes (off,off,off,off,off,off), lut 0, x 0, y 0, z 1, Reduction off )
Feature Histogram #5 ( Y Param Length, X Param UserDef2, from 0.1000000015 to 100., logarithmic, 20
bins )
Feature Histogram #6 ( Y Param UserDef4, X Param UserDef2, from 0.1000000015 to 100., logarithmic, 20
bins )
```

-continued

| Image Analysis Algorithm |
|---|
| Display Feature Histogram Results ( #5, horizontal, differential, bins + graph (Y axis linear), statistics ) |
| Data Window ( 1055, 378, 529, 330 ) |
| Display Feature Histogram Results ( #6, horizontal, cumulative +, bins + graph (Y axis linear), statistics ) |
| Data Window ( 1053, 724, 529, 330 ) |
| ANISTROPY MEASUREMENT |
| MFLDIMAGE = 6 |
| Detect ( whiter than 100, from Image0 into Binary6 delineated ) |
| Measure field ( plane MFLDIMAGE, into FLDRESULTS(4), statistics into not found ) |
| Selected parameters: Area, Perimeter, Anisotropy, Area% |
| ANISOT = 1/FLDRESULTS(3) |
| AREA = FLDRESULTS(1) |
| PERIMETER = FLDRESULTS(2) |
| SURFTOVOL = PERIMETER/AREA |
| TOTSURVOL = TOTSURVOL+SURFTOVOL |
| TOTANISOT = TOTANISOT+ANISOT |
| TOTFIELDS = TOTFIELDS+1 |
| Next ( FIELD ) |
| FILE: |
| File Feature Histogram Results ( #2, differential, statistics, bin details, channel #1 ) |
| File Line ( channel #1 ) |
| File Feature Histogram Results ( #3, cumulative +, statistics, bin details, channel #2 ) |
| File Line ( channel #2 ) |
| File Line ( channel #2 ) |
| File Line ( channel #2 ) |
| File ( "Anisotropy = ", channel #1 ) |
| File ( TOTANISOT/TOTFIELDS, channel #1, 3 digits after '.' ) |
| File Line ( channel #1 ) |
| File Line ( channel #1 ) |
| File ( "Surface Area-to-volume Ratio = ", channel #1 ) |
| File ( 2*(TOTSURVOL/TOTFIELDS), channel #1, 3 digits after '.' ) |
| File Line ( channel #1 ) |
| File Line ( channel #1 ) |
| File ( "Number of Fields = ", channel #1 ) |
| File ( TOTFIELDS, channel #1, 0 digits after '.' ) |
| File Line ( channel #1 ) |
| File Line ( channel #1 ) |
| File Line ( channel #1 ) |
| Next ( SAMPLE ) |
| File ( "Cumulative Length-wt. Histogram ", channel #1 ) |
| File Line ( channel #1 ) |
| File Feature Histogram Results ( #5, differential, statistics, bin details, channel #1 ) |
| Close File ( channel #2 ) |
| Close File ( channel #1 ) |
| END |

EXAMPLES

Fibrous nonwoven structures containing wood pulp fibers and meltblown polypropylene fibers were produced in accordance with the process described above and in FIGS. 1-3. In the process, secondary pulp fibers, CF405 pulp commercially available from the Weyerhauser Company, are suspended in an air stream and contacted with two air streams of meltblown fibrous materials, Metocene MF650X, commercially available from Basell USA Inc., impinging the air stream containing secondary pulp fibers. The merged streams were directed onto a forming wire and collected in the form of a fibrous nonwoven structure. Exemplary embodiments A through N were prepared using a two-bank system with the process setup as described in Table 1. The various samples were prepared using different basis weights ranging from 30 to 75 gsm, different polymer throughputs ranging from 0.63 to 1.76 ghm (ghm—grams of polymer though each hole in the meltblown dies per minute) and 2.5 to 5.5 pounds of polymer melt per inch of die (pih) of the total polymer throughput through the die, and different secondary pulp throughput ranging from 13.52 to 29.74 pounds of polymer melt per inch of die (pih). The meltblown dies used to produce the exemplary and comparative fibrous nonwoven structure samples described herein each have 30 holes per inch.

Comparative samples were also prepared using the process as described in, for example, U.S. Pat. No. 4,100,324 issued to Anderson et al. on Jul. 11, 1978 entitled Nonwoven Fabric and Method of Producing Same; U.S. Pat. No. 5,508,102 issued to Georger et al. on Apr. 16, 1996 entitled Abrasion Resistant Fibrous Nonwoven Structure; and in U.S. Patent Application Publication US 2003/0211802 by Keck et al. on Nov. 13, 2003 entitled Three-Dimensional Coform Nonwoven Web, all of which are herein incorporated by reference. Comparative Samples C-A through C-N correspond to the Exemplary samples A through N respectively for the different basis weights, polymer throughputs, and secondary pulp throughputs.

The specific properties and characteristics of the process to prepare the exemplary fibrous nonwoven structure that are different from the comparative samples include width of the meltblown die tips being less than 16 cm, the volumetric flow rate of the secondary air stream containing pulp (Q), the volumetric flow rate of the secondary air stream containing pulp (Q) divided by pulp throughput, the separation of the dilution and stripper air fans, and the increased air flow and design of the below-wire-exhaust system. These changes provide better air flow control and temperature control within the system.

Utilization of novel process components and forming geometries provides physical improvements to the fibrous nonwoven structure, including improvements to softness, formation, opacity, fiber diameter, anisotropy, lint amount and tensile strength. These improvements may be utilized as product quality improvements at standard rates of production or rate improvements at standard quality levels, or standard quality levels at lower basis weights, or some combination thereof. For example, production of a nonwoven coform substrate utilizing the process improvements at a polymer throughput of 1.26 ghm, can achieve a similar sheet to the comparative process at 0.63 ghm. These various physical characteristic improvements to the exemplary nonwoven substrates are discussed below.

Use of the process described herein provides a formation index improvement to fibrous nonwoven structure. Formation indices for an illustrative number of the exemplary fibrous nonwoven structure and similar comparative examples are illustrated in Table 3.

TABLE 3

Formation Index Values

| Exemplary Examples | | Comparative Examples | |
|---|---|---|---|
| Code | Formation Index | Code | Formation Index |
| A | 111.13 | C-A | 65.53 |
| B | 109.80 | C-B | 67.2 |
| C | 112.60 | C-C | 65.07 |

TABLE 1

Process Settings for Exemplary Nonwoven Substrates

| Code | Banks | Basis Weight (gsm) | Polymer Throughput (pih) | Polymer Throughput (ghm) | Pulp Throughput (pih) | Bank 1 - Volumetric Secondary Air Flow Rate = Q ($ft^3$/min) | Bank 2 - Volumetric Secondary Air Flow Rate = Q ($ft^3$/min) | Bank 1 - Q/pulp thru-put ($ft^3$/min/pih) | Bank 2 - Q/pulp thru-put ($ft^3$/min/pih) | BWE ($ft^3$/min) |
|---|---|---|---|---|---|---|---|---|---|---|
| A | 2 | 30 | 2.50 | 0.63 | 13.52 | 93.4 | 95.1 | 6.9 | 7.0 | 4500 |
| B | 2 | 45 | 2.50 | 0.63 | 13.52 | 93.4 | 95.1 | 6.9 | 7.0 | 4500 |
| C | 2 | 60 | 2.50 | 0.63 | 13.52 | 93.4 | 95.1 | 6.9 | 7.0 | 4500 |
| D | 2 | 30 | 3.50 | 0.88 | 18.93 | 93.4 | 95.1 | 4.9 | 5.0 | 4500 |
| E | 2 | 45 | 3.50 | 0.88 | 18.93 | 93.4 | 95.1 | 4.9 | 5.0 | 4500 |
| F | 2 | 60 | 3.50 | 0.88 | 18.93 | 93.4 | 95.1 | 4.9 | 5.0 | 4500 |
| G | 2 | 75 | 3.50 | 0.88 | 18.93 | 93.4 | 95.1 | 4.9 | 5.0 | 4500 |
| H | 2 | 30 | 4.50 | 1.13 | 24.33 | 93.4 | 95.1 | 3.8 | 3.9 | 4500 |
| I | 2 | 45 | 4.50 | 1.13 | 24.33 | 93.4 | 95.1 | 3.8 | 3.9 | 4500 |
| J | 2 | 60 | 4.50 | 1.13 | 24.33 | 93.4 | 95.1 | 3.8 | 3.9 | 4500 |
| K | 2 | 75 | 4.50 | 1.13 | 24.33 | 93.4 | 95.1 | 3.8 | 3.9 | 4500 |
| L | 2 | 75 | 2.50 | 0.63 | 13.52 | 93.4 | 95.1 | 6.9 | 7.0 | 4500 |
| M | 2 | 60 | 5.50 | 1.39 | 29.74 | 93.4 | 95.1 | 3.1 | 3.2 | 4500 |
| N | 2 | 75 | 5.50 | 1.39 | 29.74 | 93.4 | 95.1 | 3.1 | 3.2 | 4500 |

TABLE 2

Process Settings for Comparative Nonwoven Substrates

| Code | Banks | Basis Weight (gsm) | Polymer Throughput (pih) | Polymer Throughput (ghm) | Pulp Throughput (pih) | Bank 1 - Volumetric Secondary Air Flow Rate = Q ($ft^3$/min) | Bank 2 - Volumetric Secondary Air Flow Rate = Q ($ft^3$/min) | Bank 1 - Q/pulp thru-put ($ft^3$/min/pih) | Bank 2 - Q/pulp thru-put ($ft^3$/min/pih) | BWE ($ft^3$/min) |
|---|---|---|---|---|---|---|---|---|---|---|
| C-A | 2 | 30 | 2.50 | 0.63 | 13.52 | 55.7 | 53.0 | 4.1 | 3.9 | 2300 |
| C-B | 2 | 45 | 2.50 | 0.63 | 13.52 | 55.7 | 53.0 | 4.1 | 3.9 | 2300 |
| C-C | 2 | 60 | 2.50 | 0.63 | 13.52 | 55.7 | 53.0 | 4.1 | 3.9 | 2300 |
| C-D | 2 | 30 | 3.50 | 0.88 | 18.93 | 55.7 | 53.0 | 2.9 | 2.8 | 2300 |
| C-E | 2 | 45 | 3.50 | 0.88 | 18.93 | 55.7 | 53.0 | 2.9 | 2.8 | 2300 |
| C-F | 2 | 60 | 3.50 | 0.88 | 18.93 | 55.7 | 53.0 | 2.9 | 2.8 | 2300 |
| C-G | 2 | 75 | 3.50 | 0.88 | 18.93 | 55.7 | 53.0 | 2.9 | 2.8 | 2300 |
| C-H | 2 | 30 | 4.50 | 1.13 | 24.33 | 55.7 | 53.0 | 2.3 | 2.2 | 2300 |
| C-I | 2 | 45 | 4.50 | 1.13 | 24.33 | 55.7 | 53.0 | 2.3 | 2.2 | 2300 |
| C-J | 2 | 60 | 4.50 | 1.13 | 24.33 | 55.7 | 53.0 | 2.3 | 2.2 | 2300 |
| C-K | 2 | 75 | 4.50 | 1.13 | 24.33 | 55.7 | 53.0 | 2.3 | 2.2 | 2300 |
| C-L | 2 | 75 | 2.50 | 0.63 | 13.52 | 55.7 | 53.0 | 4.1 | 3.9 | 2300 |
| C-M | 2 | 60 | 5.50 | 1.39 | 29.74 | 55.7 | 53.0 | 1.9 | 1.8 | 2300 |
| C-N | 2 | 75 | 5.50 | 1.39 | 29.74 | 55.7 | 53.0 | 1.9 | 1.8 | 2300 |

TABLE 3-continued

| Formation Index Values | | | |
|---|---|---|---|
| Exemplary Examples | | Comparative Examples | |
| Code | Formation Index | Code | Formation Index |
| D | 103.00 | C-D | 54.57 |
| E | 100.33 | C-E | 50.4 |
| F | 102.8 | C-F | 52.6 |
| I | 88.8 | C-I | 42.73 |
| J | 80.73 | K | 42.67 |
| K | 83.4 | C-K | 44.47 |
| L | 102.47 | C-L | 68.53 |
| M | 78.73 | C-M | 35.47 |
| N | 73.93 | C-N | 36.07 |

As shown by the examples, formation indices decrease as the polymeric throughput of the process increases at each basis weight. For example, Code C of the exemplary nonwovens was manufactured at 60 gsm at a polymer throughput of 0.63 ghm (2.5 pih) and has a formation index of 112.6 while Code M of the exemplary nonwovens was manufactured at 60 gsm at a polymer throughput of 1.39 ghm (5.5 pih) and has a formation index of 78.73. However, as can be seen by comparing the tables, the formation index of the exemplary substrates are higher than every comparative sample without taking into consideration basis weight or polymer throughput of the machine, having a formation index of at least 70.

Figure 4:
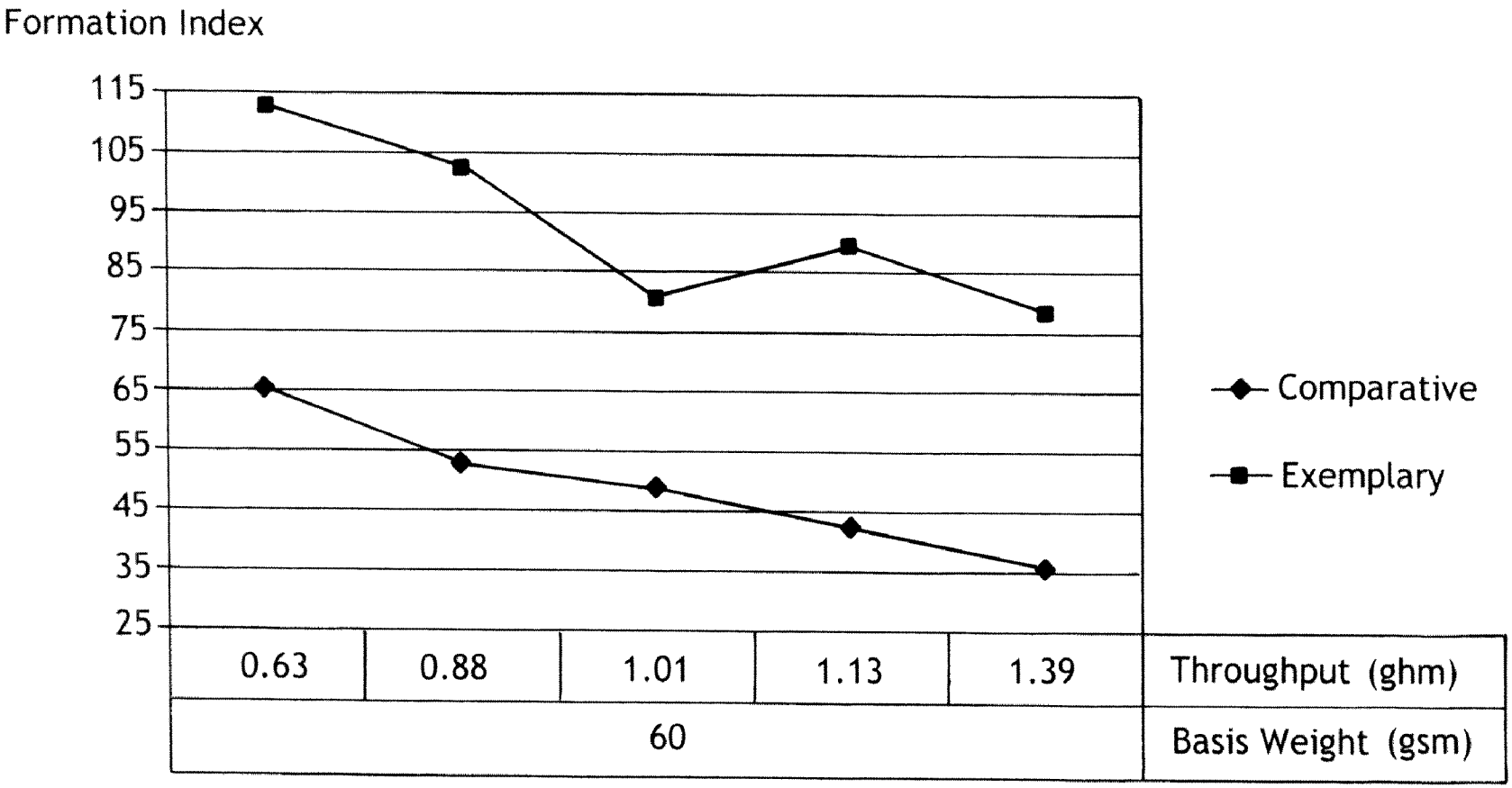
FIG. 4 illustrates a visual representation of the improvement in formation index for the fibrous nonwoven structure manufactured using the process disclosed herein compared to comparative samples at a basis weight of 60 gsm.

FIG. 4 illustrates a visual representation of the improvement in formation index for nonwoven coform substrates using the process disclosed herein. FIG. 4 illustrates the formation index of the exemplary fibrous nonwoven structure described herein at a basis weight of 60 gsm at polymer throughputs ranging from 0.63 to 1.39 ghm (2.5 pih to 5.5 pih) in relation to the comparative examples at a basis weight of 60 gsm at the same throughputs. The exemplary line indicates the formation index improvements obtained with implementing the process described herein when compared to the comparative fibrous nonwoven structures.

Use of the process described herein also provides an opacity improvement to dry fibrous nonwoven structures at a given basis weight. Opacity percentages and basis weights for an illustrative number of the exemplary fibrous nonwoven structure and similar comparative examples are illustrated in Table 5.

TABLE 5

| Opacity Percentage Values | | | | | |
|---|---|---|---|---|---|
| Exemplary Examples | | | Comparative Examples | | |
| Code | Basis Weight (gsm) | Opacity (%) | Code | Basis Weight (gsm) | Opacity (%) |
| A | 30 | 63.74 | C-A | 30 | 58.80 |
| B | 45 | 74.87 | C-B | 45 | 70.88 |
| C | 60 | 82.65 | C-C | 60 | 78.10 |
| D | 30 | 60.49 | C-D | 30 | 55.67 |
| E | 45 | 72.85 | C-E | 45 | 68.33 |
| F | 60 | 79.15 | C-F | 60 | 73.73 |
| G | 75 | 84.11 | C-G | 75 | 80.82 |
| I | 45 | 72.94 | C-I | 45 | 64.17 |
| J | 60 | 80.42 | C-J | 60 | 73.56 |
| K | 75 | 83.89 | C-K | 75 | 78.53 |
| L | 75 | 84.18 | C-L | 75 | 83.37 |
| M | 60 | 78.03 | C-M | 60 | 78.025 |
| N | 75 | 82.47 | C-N | 75 | 76.41 |

As shown in Table 5, opacity decreases as the as the polymeric throughput of the process increases at each basis weight. For example, Code C of the exemplary nonwoven was processed having a basis weight of 60 gsm at a polymer throughput of 0.63 ghm (2.5 pih) and has an opacity value of 82.65%, while Code J of the exemplary nonwovens was manufactured at 60 gsm at a polymer throughput of 1.13 ghm (4.5 pih) has an opacity value of 80.42%. As can be seen by comparing the tables, the opacity of the exemplary substrates at a given basis weight are much higher when compared to the comparative sample at the same basis weight.

Figure 5:
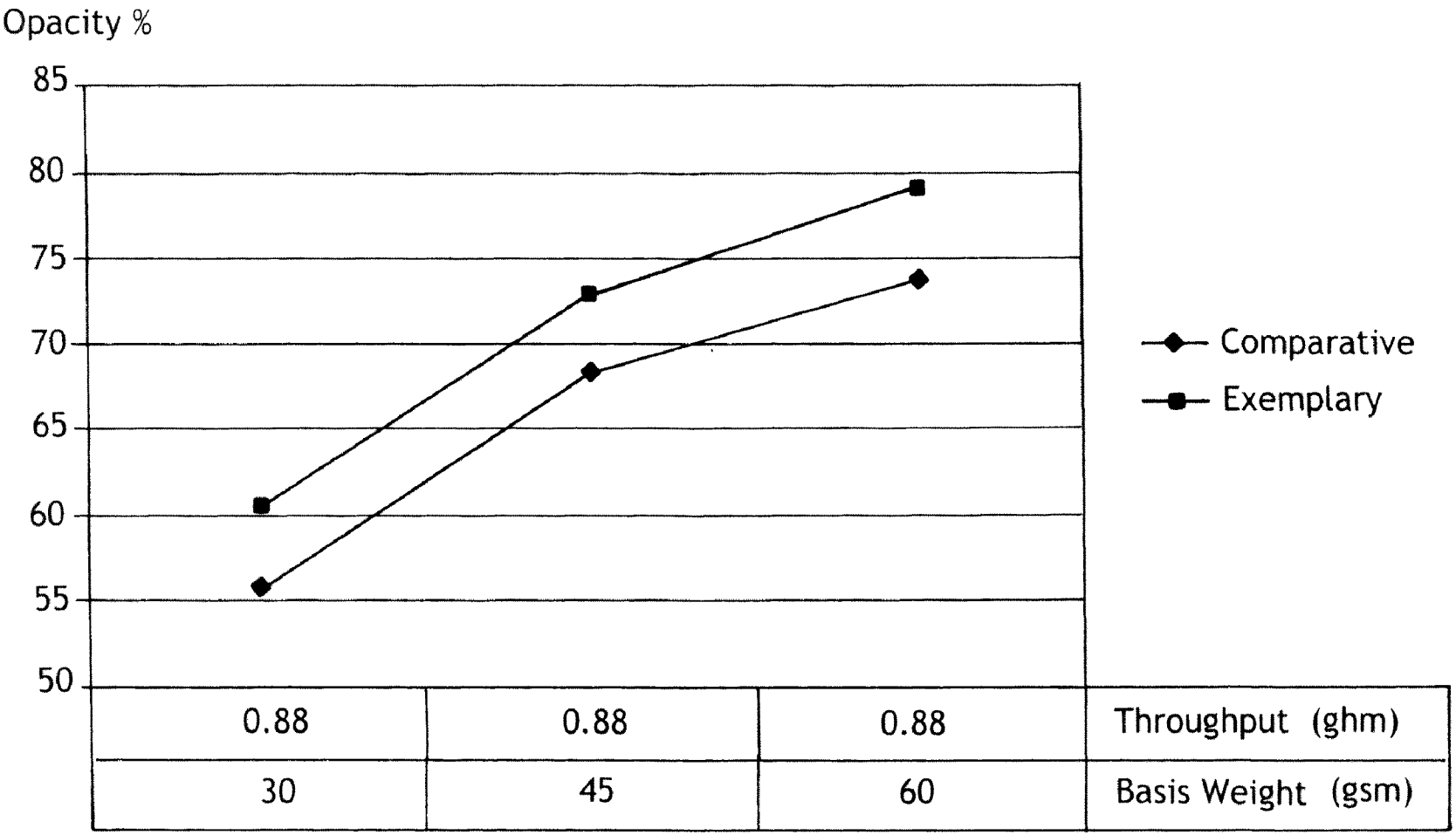
FIG. 5 illustrates a visual representation of the opacity values for the fibrous nonwoven structure described herein compared to comparative samples at various basis weights.

Unexpectedly, the opacity of the exemplary substrates at lower basis weight are similar to the comparative samples at higher basis weights. In fact, the exemplary samples have similar opacity values of greater than 72% at basis weight greater than 35 gsm and less than 55 gsm while comparative samples only reach this opacity value at a basis weight of 60 gsm. FIG. 5 illustrates a visual representation of the opacity values for the exemplary fibrous nonwoven structure described herein at various basis weights at 0.88 ghm (3.5 pih) polymer throughput in relation to the comparative examples at the same basis weights at the same polymer throughput. Similar opacity values are shown for the exemplary samples having a basis weight of 45 gsm as the comparative samples at a basis weight of 60 gsm. Thus, similar products can be achieved using fewer raw materials.

Use of the process described herein also provides a surface roughness improvement to fibrous nonwoven structure. Surface roughness for an illustrative number of the exemplary fibrous nonwoven structure and similar comparative examples are illustrated in Table 6.

TABLE 6

| Surface Roughness Values | | | | | |
|---|---|---|---|---|---|
| Exemplary Examples | | | Comparative Examples | | |
| Code | Airside SWa (mm) | Wireside SWa (mm) | Code | Airside SWa (mm) | Wireside SWa (mm) |
| F | 0.041 | 0.055 | C-F | 0.078 | 0.0671 |
| M | 0.052 | 0.053 | C-M | 0.089 | 0.0795 |

The surface roughness was found to be less than about 0.06 mm on both the wire side and on the non-wire side of coform substrate produced with the process described herein. The improved surface roughness values indicate that utilizing the process described herein produces smoother sheets, improving softness characteristics on both the wire and non-wire side.

Another aspect of the present disclosure is the production of a fibrous nonwoven structure having smaller meltblown fiber diameters, smaller volume weighted mean fiber diameter and anisotropy. Fibrous nonwoven structures having smaller meltblown fibers provide for better capture of the pulp fibers and a smoother/softer hand feel for the finished product.

TABLE 7

| Meltblown Fiber Diameter, Volume-Weight Diameter and Anistotropy Values | | | | | | | |
|---|---|---|---|---|---|---|---|
| Exemplary Examples | | | | Comparative Examples | | | |
| Code | Meltblown Fiber Diameter (μm) | Meltblown Volume Weighted Mean Fiber Diameter (μm) | Anisotropy | Code | Meltblown Fiber Diameter (μm) | Meltblown Volume Weighted Mean Fiber Diameter (μm) | Anisotropy |
| A | 2.35 | 4.26 | 0.68 | C-A | 2.84 | 5.22 | 0.71 |
| B | 3.47 | 6.6 | 0.53 | C-B | 3.00 | 5.4 | 0.66 |
| C | 3.01 | 5.83 | 0.55 | C-C | 2.56 | 4.79 | 0.80 |
| D | 3.27 | 6.05 | 0.52 | C-D | 3.10 | 6.3 | 0.78 |
| E | 3.24 | 5.65 | 0.55 | C-E | 3.78 | 6.48 | 0.76 |
| F | 3.01 | 6.5 | 0.63 | C-F | 4.02 | 9.84 | 0.84 |
| G | 3.32 | 6.86 | 0.56 | C-G | 3.72 | 9.21 | 0.68 |
| I | 2.79 | 5.09 | 0.50 | C-I | 4.88 | 8.16 | 0.85 |
| J | 2.56 | 4.55 | 0.52 | C-J | 4.46 | 8.05 | 0.673 |
| K | 2.56 | 6.92 | 0.55 | C-K | 4.78 | 9.66 | 0.74 |
| M | 3.49 | 8.17 | 0.57 | C-M | 4.89 | 9.68 | 0.72 |
| N | 3.01 | 5.39 | 0.52 | C-N | 5.2 | 10.28 | 0.73 |

Figure 6:
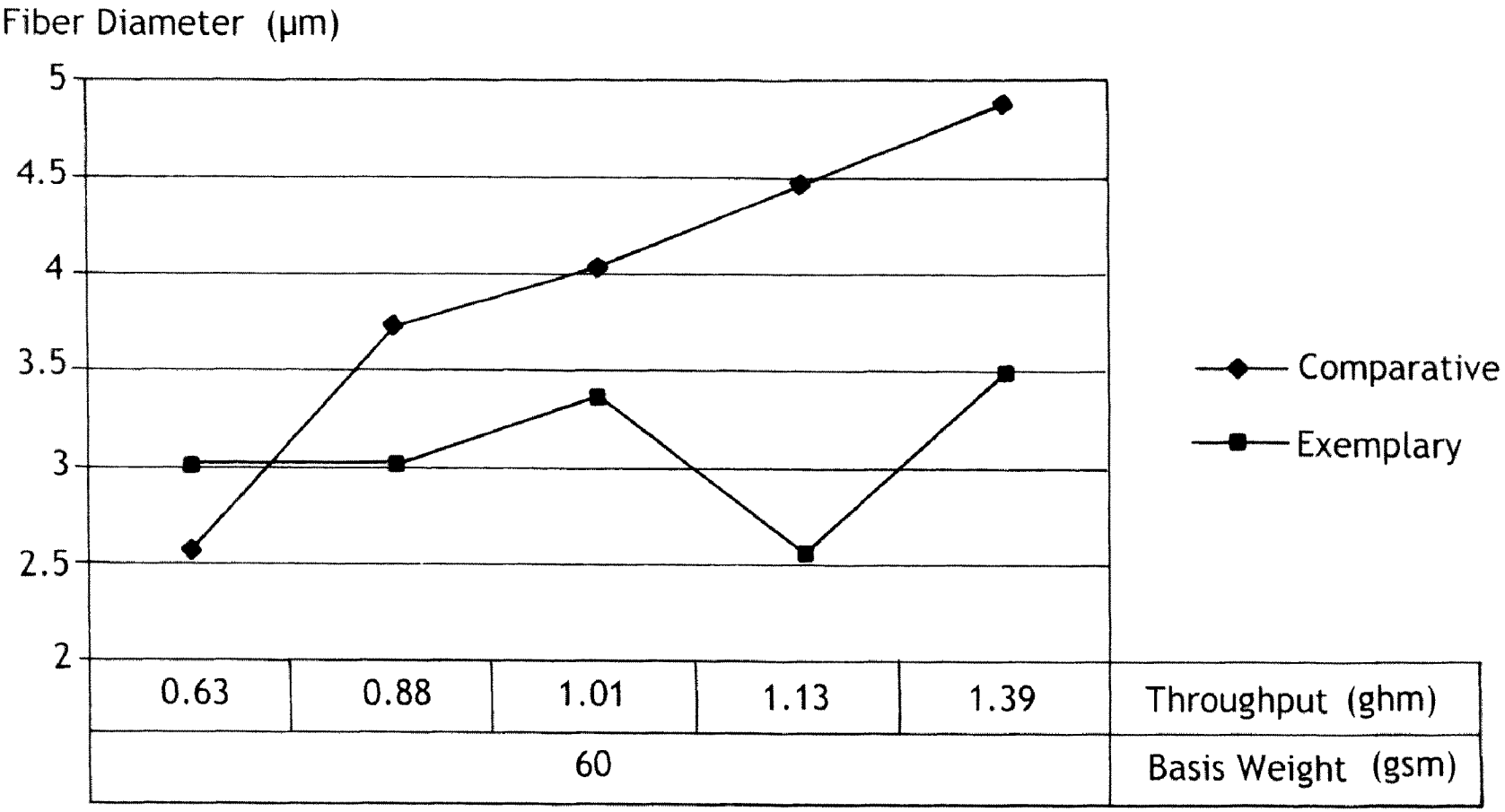
FIG. 6 illustrates a visual representation of the fiber diameter of the fibrous nonwoven structure manufactured using the process disclosed herein compared to comparative samples at a basis weight of 60 gsm.

As illustrated in Table 7, in an exemplary aspect, the exemplary fibrous nonwoven structures prepared using the process described herein are produced with smaller meltblown fiber diameters at higher throughputs indicating a softer feel at each throughput when compared to the comparative examples. The exemplary nonwoven basesheets have an average meltblown fiber diameter of less than 3.5 μm at a polymer throughput of between about 0.88 ghm and 1.39 ghm (3.5 pih to 5.5 pih). The comparative examples have an average meltblown fiber diameter of greater than 3.5 μm at these polymer throughputs. FIG. 6 illustrates a visual representation of the polymer fiber diameter for the exemplary fibrous nonwoven structure described herein at a basis weight of 60 gsm at various polymer throughputs in relation to the comparative examples at a basis weight of 60 gsm at the same throughputs. The exemplary samples have smaller fiber diameters at higher throughputs of polymer indicating that softer fibrous nonwoven structures may be made at higher polymer throughputs.

Also illustrated in Table 7 is the exemplary fibrous nonwoven structures have smaller volume-weight diameter meltblown fibrous materials. As illustrated in Table 7, in an exemplary aspect, the exemplary fibrous nonwoven structures have an average meltblown fiber volume-weight diameter of between about 4.0 and about 8.0 mm at a polymer throughput of between about 0.88 ghm and 1.39 ghm (2.5 pih and 5.5 pih). The exemplary samples have smaller fiber diameters at higher throughputs of polymer indicating that softer fibrous nonwoven structures may be made at higher polymer throughputs.

The exemplary fibrous nonwoven structures have improved anisotropy values. As illustrated in Table 7, in an exemplary aspect, the fibrous nonwoven structure of the present disclosure has an average meltblown fiber anisotropy ratio of less than 0.65. The comparative examples have an anisotropy value of at least 0.68 and greater. Since the anisotropy ratio for the exemplary samples are less, the sheet has less variation in the polymer fiber orientation. This allows for easier processing and conversion into final products such as wet wipes while indicating to a consumer a stronger sheet.

Use of the process described herein provides an improvement to the amount of lint present on the fibrous nonwoven structure. Lint counts for an illustrative number of the exemplary fibrous nonwoven structure and similar comparative examples are illustrated in Table 8.

TABLE 8

| Lint Count Values | | | |
|---|---|---|---|
| Exemplary Samples | | Comparative Samples | |
| Code | Lint Count | Code | Lint Count |
| A | 924.3 | C-A | 1058.7 |
| B | 577.2 | C-B | 1239.7 |
| C | 342.7 | C-C | 1169.7 |
| D | 855.2 | C-D | 1206.8 |
| E | 656.8 | C-E | 1233.2 |
| F | 427.7 | C-F | 1289.0 |
| G | 229.5 | C-G | 1308.5 |
| I | 676 | C-I | 979.3 |
| J | 534.5 | C-J | 1202.5 |
| K | 397.7 | C-K | 1505.8 |
| L | 316.5 | C-L | 1367.3 |
| M | 668.0 | C-M | 1521.5 |
| N | 498.0 | C-N | 1384 |

Figure 7:
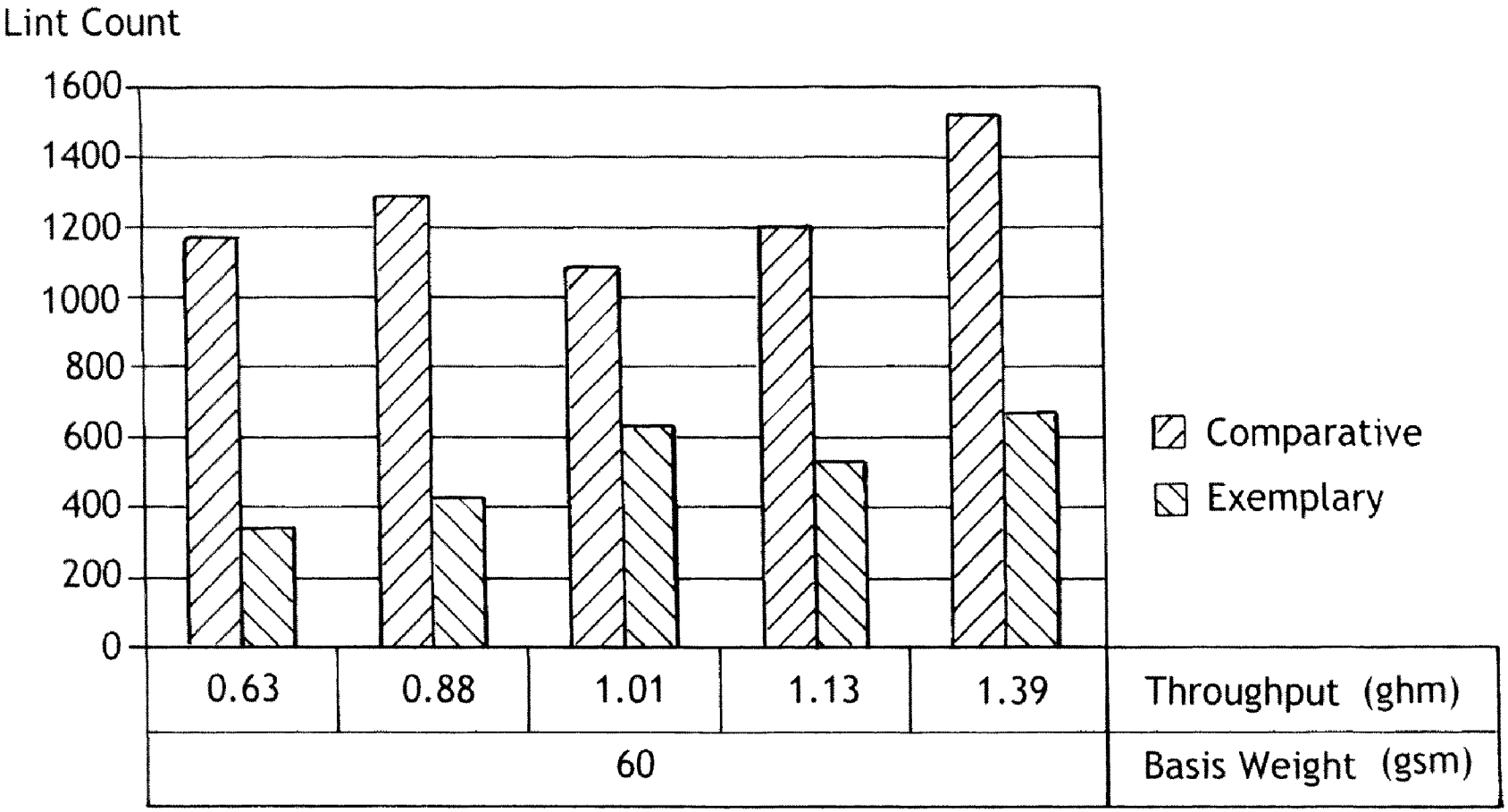
FIG. 7 illustrates a visual representation of the lint count of the fibrous nonwoven structure manufactured using the process disclosed herein compared to comparative samples at a basis weight of 60 gsm.

As illustrated in Table 8, the lint count for the exemplary fibrous nonwoven structure is lower for each sample tested when compared to the comparative samples. For example, Code A of the exemplary nonwoven has the highest lint count at 924.3 while Code C-I has the lowest value for lint count at 979.3. FIG. 7 illustrates a visual representation of the lint count for the exemplary fibrous nonwoven structure described herein at a basis weight of 60 gsm and polymer throughputs ranging from 0.63 to 1.39 ghm (2.5 pih to 5.5 pih) in relation to the comparative examples at a basis weight of 60 gsm at the same throughputs. The exemplary samples have lower lint counts than the comparative examples.

Use of the process described herein provides an improvement to the machine direction tensile strength present on the fibrous nonwoven structure. Machine direction (MD) tensile strength for an illustrative number of the exemplary fibrous nonwoven structure and similar comparative examples are illustrated in Table 9.

TABLE 9

| Machine Direction Tensile Strength Values | | | |
|---|---|---|---|
| Exemplary Samples | | Comparative Samples | |
| Code | MD Tensile Strength (peak load g * f) | Code | MD Tensile Strength (peak load g * f) |
| A | 479.5 | C-A | 325.0 |
| B | 717.9 | C-B | 534.0 |
| C | 954.3 | C-C | 726.2 |
| D | 386.5 | C-D | 269.2 |
| E | 606.4 | C-E | 455.8 |
| F | 900.4 | C-F | 615.8 |
| G | 1115.4 | C-G | 782.0 |
| I | 575.7 | C-I | 389.1 |
| J | 786.2 | C-J | 523.5 |
| K | 1008.2 | C-K | 696.9 |
| L | 1147.2 | C-L | 871.2 |
| M | 662.2 | C-M | 462.4 |
| N | 875.5 | C-N | 546.0 |

Figure 8:
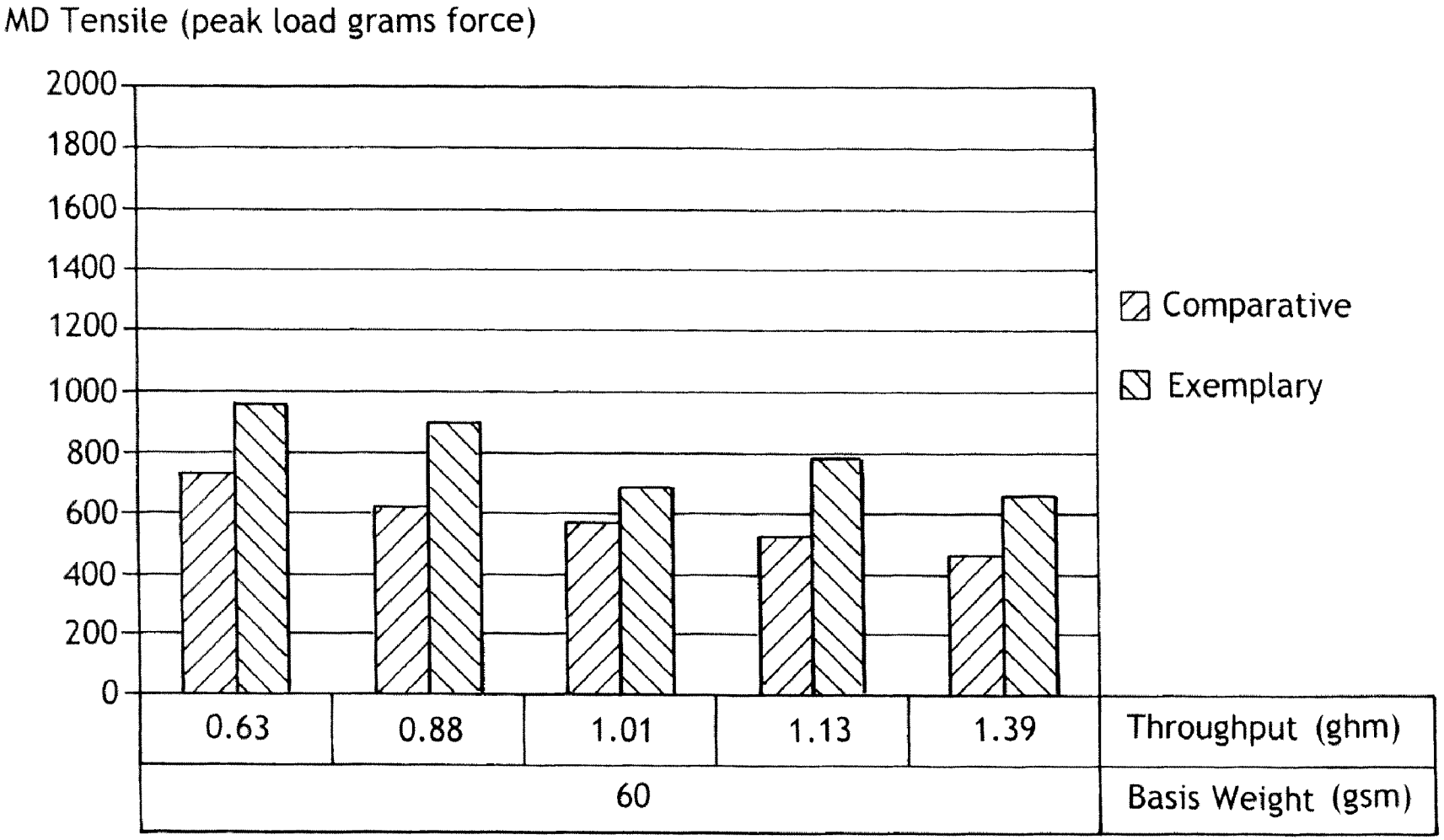
FIG. 8 illustrates a visual representation of the MD tensile strength of the fibrous nonwoven structure manufactured using the process disclosed herein compared to comparative samples at a basis weight of 60 gsm.

As illustrated in Table 9, the MD tensile strength for the exemplary fibrous nonwoven structure is higher at higher polymer throughput rates when compared to the comparative samples. For example, Code F of the exemplary nonwoven was processed having a basis weight of 60 gsm at a polymer throughput of 0.88 ghm (3.5 pih) and has an MD tensile strength of 900.4 while Code C-F of the comparative samples was processed having a basis weight of 60 gsm at a polymer throughput of 0.88 ghm (3.5 pih) and has an MD tensile strength of 615.8. FIG. 8 illustrates a visual representation of the MD tensile strength for the exemplary fibrous nonwoven structure described herein at a basis weight of 60 gsm and polymer throughputs ranging from 0.63 to 1.39 ghm (2.5 pih to 5.5 pih) in relation to the comparative examples at a basis weight of 60 gsm at the same throughputs. The exemplary samples have higher MD tensile strengths than the comparative examples at the same throughput.

When introducing elements of the present disclosure or the preferred aspects(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above method and products without departing from the scope of the disclosure, it is intended that all matter contained in the above description shall be interpreted as illustrative and not in a limiting sense.

The invention claimed is:

1. A fibrous nonwoven structure comprising:

at least one meltblown fibrous material, the at least one meltblown fibrous material having an average diameter of about 0.5 to 40 μm;

at least one secondary fibrous material, wherein a weight ratio of the at least one secondary fibrous material to the at least one meltblown fibrous material is in between about 40/60 to about 90/10;

wherein a basis weight of the fibrous nonwoven structure is in a range of about 20 gsm to about 500 gsm; and wherein the formation index of the fibrous nonwoven structure is greater than 70.

2. The fibrous nonwoven structure of claim 1 wherein the at least one secondary fibrous material is incorporated into a mixture of the at least one meltblown fibrous material.

3. The fibrous nonwoven structure of claim 1 having an average meltblown fibrous material fiber diameter of less than 3.5 μm at a polymer throughput of between about 0.88 ghm and 1.76 ghm.

4. The fibrous nonwoven structure of claim 1 having an average meltblown fibrous material fiber diameter of less than 3.5 μm at a polymer throughput of between about 3.5 pih and 7 pih.

5. The fibrous nonwoven structure of claim 1 wherein the formation index of the fibrous nonwoven structure is between about 70 to 135.

6. The fibrous nonwoven structure of claim 1 wherein the formation index of the fibrous nonwoven structure is between about 75 to 115.

7. The fibrous nonwoven structure of claim 1 wherein a machine tensile strength of the fibrous nonwoven structure is between about 650 grams-force and 1500 grams-force at a polymer throughput of between about 0.88 ghm and 1.76 ghm.

8. The fibrous nonwoven structure of claim 1 wherein a machine tensile strength of the fibrous nonwoven structure is between about 650 grams-force and 1500 grams-force at a polymer throughput of between about 3.5 pih and 7 pih.

9. The fibrous nonwoven structure of claim 1, wherein a surface roughness of the fibrous nonwoven structure is in a range of about 0.03 to about 0.06 mm.

10. The fibrous nonwoven structure of claim 1, wherein an opacity of the fibrous nonwoven structure is greater than 72 percent at a basis weight of between about 35 gsm and 55 gsm.

11. The fibrous nonwoven structure of claim 1 having a lint count between about 200 to about 950.

12. The fibrous nonwoven structure of claim 1 wherein a volume weighted mean diameter of the meltblown fibrous materials is between about 4.0 and about 8.0 μm at a polymer throughput of between about 0.88 ghm and 1.76 ghm.

13. The fibrous nonwoven structure of claim 1 wherein a volume weighted mean diameter of the meltblown fibrous materials is between about 4.0 and about 8.0 μm at a polymer throughput of between about 3.5 pih and 7.0 pih.

14. The fibrous nonwoven structure of claim 1 having an anisotropy ratio between about 0.4 and about 0.65.

15. The fibrous nonwoven structure of claim 1 for use as a wet wipe, wherein the wet wipe has from about 150 to 600 weight percent of a liquid based on a dry weight of the fibrous nonwoven structure.

16. A fibrous nonwoven structure comprising:

at least one meltblown fibrous material, the at least one meltblown fibrous material having an average diameter of about 0.5 to 40 μm;

at least one secondary fibrous material, wherein a weight ratio of the at least one secondary fibrous material to the at least one meltblown fibrous material is in between about 40/60 to about 90/10;

wherein an opacity of the fibrous nonwoven structure is greater than 72 percent and a basis weight of between about 35 gsm and less than 55 gsm.

17. The fibrous nonwoven structure of claim 16 having an average meltblown fibrous material diameter of less than 3.5 μm at a polymer throughput of between about 0.88 ghm and 1.76 ghm.

18. The fibrous nonwoven structure of claim 16 having an average meltblown fibrous material diameter of less than 3.5 μm at a polymer throughput of between about 3.5 pih and 7.0 pih.

19. The fibrous nonwoven structure of claim 16 wherein the formation index of the fibrous nonwoven structure is between about 70 to 135.

20. The fibrous nonwoven structure of claim 16 wherein a machine tensile strength of the fibrous nonwoven structure is between about 650 grams-force and 1500 grams-force at a polymer throughput of between about 0.88 ghm and 1.76 ghm.

21. The fibrous nonwoven structure of claim 16 wherein a machine tensile strength of the fibrous nonwoven structure is between about 650 grams-force and 1500 grams-force at a polymer throughput of between about 3.5 pih and 7.0 pih.

22. The fibrous nonwoven structure of claim 16, wherein a surface roughness of the fibrous nonwoven structure is in a range of about 0.03 to about 0.06 mm.

23. The fibrous nonwoven structure of claim 16 having a lint count between about 200 to about 950.

24. The fibrous nonwoven structure of claim 16 wherein a volume weighted mean diameter of the meltblown fibrous materials is between about 4.0 and about 8.0 μm at a polymer throughput of between about 0.88 ghm and 1.76 ghm.

25. The fibrous nonwoven structure of claim 16 wherein a volume weighted mean diameter of the meltblown fibrous materials is between about 4.0 and about 8.0 μm at a polymer throughput of between about 3.5 pih and 7.0 pih.

26. The fibrous nonwoven structure of claim 16 having an anisotropy ratio between about 0.4 and about 0.65.

27. The fibrous nonwoven structure of claim 16 for use as a wet wipe, wherein the wet wipe has from about 150 to 600 weight percent of a liquid based on a dry weight of the fibrous nonwoven structure.

28. A process of making a fibrous nonwoven structure comprising:

providing a first stream and a second stream of meltblown fibrous materials with a meltblown die, the meltblown fibrous materials having an average diameter of about 0.5 to 40 μm, the first stream and second stream meeting at a formation zone, wherein the meltblown die has a machine direction width of less than 16 cm;

providing a stream of natural fibers meeting the first stream and the second stream at the formation zone and forming into a product stream;

collecting the product stream on a forming wire as a mixture of meltblown fibrous materials and natural fibers; and wherein the formation index of the fibrous nonwoven structure is between about 70 to 135.

* * * * *